US011542806B2

(12) United States Patent
Fellinghaug et al.

(10) Patent No.: US 11,542,806 B2
(45) Date of Patent: Jan. 3, 2023

(54) METHOD AND APPARATUS OF UNTETHERED CASING AND BORE HOLE SURVEY THROUGH THE DRILL STRING WHILE TRIPPING OUT DRILL PIPE

(71) Applicants: Wireless Instrumentation Systems AS, Trondheim (NO); WWT International Coiled Tubing Services, LLC, Houston, TX (US)

(72) Inventors: Jarl André Fellinghaug, Trondheim (NO); Anton Kulyakhtin, Trondheim (NO); Robert Norlander, Houston, TX (US)

(73) Assignees: Wireless Instrumentation Systems AS, Trondheim (NO); WWT International Coiled Tubing Services, LLC, Houston, TX (US)

( * ) Notice: Subject to any disclaimer, the term of this patent is extended or adjusted under 35 U.S.C. 154(b) by 165 days.

(21) Appl. No.: 16/995,683

(22) Filed: Aug. 17, 2020

(65) Prior Publication Data

US 2021/0054728 A1 Feb. 25, 2021

Related U.S. Application Data

(60) Provisional application No. 62/911,898, filed on Oct. 7, 2019, provisional application No. 62/897,136, filed (Continued)

(51) Int. Cl.
*E21B 47/002* (2012.01)
*E21B 47/10* (2012.01)

(Continued)

(52) U.S. Cl.
CPC ..... *E21B 47/0025* (2020.05); *E21B 47/16* (2013.01); *E21B 47/26* (2020.05); *E21B 49/003* (2013.01)

(58) Field of Classification Search
None
See application file for complete search history.

(56) References Cited

U.S. PATENT DOCUMENTS 4,484,628 A 11/1984 Lanmon, II
4,597,440 A 7/1986 Pottier (Continued)

FOREIGN PATENT DOCUMENTS

GB 2002902 5/1982
GB 2 520 969 6/2015
WO WO 2021/034780 2/2021

OTHER PUBLICATIONS

International Written Opinion, re PCT/US2020/046709, dated Jul. 12, 2021.

(Continued)

*Primary Examiner* — Curtis A Kuntz
*Assistant Examiner* — Jerold B Murphy
(74) *Attorney, Agent, or Firm* — Knobbe, Martens, Olson & Bear, LLP

(57) ABSTRACT

A method for measuring the thickness of casing in a wellbore and/or analyzing the inner surface of the cased or non-cased wellbore. The method includes an positioning an untethered logging tool in a drill string, receiving the logging tool in a catcher positioned within the drill string, positioning a plurality ultrasonic transducers with the average distance between the outer surface of the plurality of transducers and an interior surface of the catcher sub being less than 0.8 mm, and moving the drill string and the logging tool toward a mouth of the borehole while transmitting acoustic waves through the catcher sub toward the wellbore casing and receiving acoustic waves back to the logging tool after the acoustic waves interact with the wellbore casing and reflect through the catcher.

51 Claims, 24 Drawing Sheets

Related U.S. Application Data on Sep. 6, 2019, provisional application No. 62/888,943, filed on Aug. 19, 2019.

(51) Int. Cl.

| | |
|---|---|
| ***E21B 49/00*** | (2006.01) |
| ***E21B 47/085*** | (2012.01) |
| ***E21B 47/26*** | (2012.01) |
| ***E21B 47/16*** | (2006.01) |

(56) References Cited

U.S. PATENT DOCUMENTS

| | | | | |
|---|---|---|---|---|
| 4,844,161 | A | 7/1989 | Rankin et al. | |
| 5,589,825 | A * | 12/1996 | Pomerleau | E21B 34/14 175/49 |
| 6,050,141 | A | 4/2000 | Tello | |
| 6,119,777 | A | 9/2000 | Runia | |
| 7,134,493 | B2 | 11/2006 | Runia | |
| 7,913,806 | B2 | 3/2011 | Pabon et al. | |
| 8,866,632 | B2 | 10/2014 | Hrametz et al. | |
| 11,156,077 | B2 * | 10/2021 | Nordlander | E21B 47/085 |
| 2009/0173538 | A1 | 7/2009 | Estes et al. | |
| 2012/0080184 | A1 | 4/2012 | Jahangir et al. | |
| 2016/0017678 | A1 | 1/2016 | Hrametz et al. | |
| 2016/0237759 | A1 | 8/2016 | Li-Leger et al. | |
| 2017/0275987 | A1 | 9/2017 | Al-Hussain et al. | |
| 2017/0350242 | A1 * | 12/2017 | Nguyen | G01V 1/44 |
| 2019/0376382 | A1 | 12/2019 | Nordlander | |
| 2021/0254958 | A1 * | 8/2021 | Omar | E21B 47/113 |

OTHER PUBLICATIONS

International Search Report and Written Opinion, re PCT Application No. PCT/US2020/046709, dated Dec. 3, 2021.

International Preliminary Report on Patentability, re PCT Application No. PCT/US2020/046709, dated Dec. 6, 2021.

* cited by examiner

Notation:

- T – ultrasound wave in the transmitter
- l,s - compressional and shear wave in the catcher sub, respectively
- lw – compressional wave in brine/mud
- lc, sc – compressional and shear wave in the casing, respectively
- R – ultrasound wave in the receiver Overview of echoes' path coming from the casing inner surface:

- [T-l-lw-lw-l-R]
- [T-l-lw-lw-s-R, T-s-lw-lw-l-R]
- [T-l-l-l-lw-lw-l-R]
- [T-s-lw-lw-s-R]

Overview of echoes' path coming from the casing outer surface:

- [T-l-lw-lc-lc-lw-l-R]
- [T-l-lw-lc-sc-lw-l-R, T-l-lw-sc-lc-lw-l-R]
- [T-l-lw-lc-lc-lw-l-R]
- [T-l-lw-sc-sc-lw-l-R]
- [T-l-lw-lc-lc-lw-s-R, T-s-lw-lc-lc-lw-l-R]
- [T-l-lw-lc-sc-lw-l-R, T-l-lw-sc-lc-lw-l-R]
- [T-l-lw-lc-sc-lw-s-R, T-l-lw-sc-lc-lw-s-R, T-s-lw-lc-sc-lw-l-R, T-s-lw-sc-lc-lw-l-R]
- [T-l-lw-sc-sc-lw-s-R, T-s-lw-sc-sc-lw-l-R]
- [T-s-lw-lc-sc-lw-s-R, T-s-lw-sc-lc-lw-s-R]
- [T-s-lw-lc-lc-lw-s-R]
- [T-s-lw-sc-sc-lw-s-R]

Comments:

- Echoes arriving with overlapping time are combined together. The arrival time of each echo will vary with the geometry of the transducer and the downhole environment
- Additional echoes having several reflections inside the catcher sub or casing are deleted from the overview for brevity, however, they have to be taken into consideration in the data analysis.

FIG 3.

Used file:

- Experiment_20deg_withWater_backplate_PICO.py
- Main_2D_linear.py

**TABLE 7.5—FORMULA FACTORS AND *D/t* RANGE FOR TRANSITION COLLAPSE**

| Grade* | Formula Factor F | Formula Factor G | *D/t* Range |
|---|---|---|---|
| H–40 | 2.063 | 0.0325 | 27.01–42.64 |
| –50 | 2.003 | 0.0347 | 25.63–38.83 |
| J–K–55 | 1.989 | 0.0360 | 25.01–7.21 |
| –60 | 1.983 | 0.0373 | 24.42–5.73 |
| –70 | 1.984 | 0.0403 | 23.38–33.17 |
| C–75 & E | 1.990 | 0.0418 | 22.91–32.05 |
| L–N–80 | 1.998 | 0.0434 | 22.47–1.02 |
| C–90 | 2.017 | 0.0466 | 21.69–29.18 |
| C-T–95 & X | 2.029 | 0.0482 | 21.33–28.36 |
| –100 | 2.040 | 0.0499 | 21.00–27.60 |
| P–105 & G | 2.053 | 0.0515 | 20.70–26.89 |
| P–100 | 2.066 | 0.0532 | 20.41–26.22 |
| –120 | 2.092 | 0.0565 | 19.88–25.01 |
| Q–125 | 2.106 | 0.0582 | 19.63–24.46 |
| –130 | 2.119 | 0.0599 | 19.40–23.94 |
| S–135 | 2.133 | 0.0615 | 19.18–23.44 |
| –140 | 2.146 | 0.0632 | 18.97–22.98 |
| –150 | 2.174 | 0.0666 | 18.57–22.11 |
| –155 | 2.188 | 0.0683 | 18.37–21.70 |
| –160 | 2.202 | 0.0700 | 18.19–21.32 |
| –170 | 2.231 | 0.0734 | 17.82–20.60 |
| –180 | 2.261 | 0.0769 | 17.47–19.93 |

*Grades indicated without a letter designation are not API grades but are grades in use or grades being considered for use. They are shown for information purposes.

FIG. 16

METHOD AND APPARATUS OF UNTETHERED CASING AND BORE HOLE SURVEY THROUGH THE DRILL STRING WHILE TRIPPING OUT DRILL PIPE

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND

Field

This disclosure relates to bore hole survey logging assemblies and methods of logging bore holes.

Related Art

Bore hole/casing logging and evaluation is a frequently used service in the oil and gas industry to evaluate the state and integrity of the well bore. Casing integrity is a frequent concern among operators, especially during drilling long horizontal sections through the cased part of the well. The rotating drill string can in some cases do critical damage to the casing string, thus destroying the wells sealing integrity to the surrounding environment. Conventional methods of borehole and casing surveys are performed by first clearing the borehole for drill pipe, then mobilizing a wireline unit and a borehole logging tool, like an Ultrasonic Imager Tool (USIT by Schlumberger) with a specialized logging crew to the site. Conventional USIT logs can in some cases require several days in post-processing and analysis by specialists, which adds time and cost before the drilling crew can distinguish the state of the well, in order to move forward. This conventional method requires extra services and results in non-productive time and additional costs for the drilling contractor. In today's high demand drilling market, drilling contractors desire to reduce the non-productive time to a minimum in order to be competitive and more efficient. On the other side, well integrity assurance is an important topic in today's field developments, and several regulatory requirements to well integrity surveying exist for environmental and safety considerations.

A new solution for enabling well integrity surveys, while not compromising on field development efficiency like introducing non-productive time, is desirable.

SUMMARY

In one aspect, the desirability of providing an integrated service and utilizing (piggy back) normal drilling operations and routines to not introduce non-productive time. It should desirably also remove the need for the costly and time-consuming wireline service has been recognized. In one aspect, the desirability of providing high resolution and reliable casing surveys and also provide an instant well log report after the survey is done, has been recognized.

In one aspect, a desirable method of logging would include (1) providing an untethered casing dimension logging tool is sized and shaped such that it can be dropped inside the drill pipe, similar to a drift dart, which is caught and retained in a catcher sub inside the drill pipe; (2) dropping the inside the drill pipe just before the drill pipe is pulled out of hole; (3) pulling out the pipe, using the logging tool to scan and measure the casing dimensions as the pipe is pulled out of the well bore. Desirably, this method would further include retrieving the logging tool at the surface and downloading and presenting the well bore survey on a computer, such as displayed on a Laptop/PC or Tablet, enabling instant well integrity assurance. Advantageously, this method would desirably introduce a minimum of additional non-productive time, while still achieving the well integrity assurance.

Advantageously, in some aspects, the new solution should desirably provide the following:

The method and assembly would correlate the depth and position in the wellbore. Furthermore, the logging tool would provide a self-sustained power system. To be able to measure casing and bore hole dimensional data quickly and accurately through the drill pipe, the ultrasonic transducer arrangement should desirably be able to overcome the noise due to the reverberations and reflection from the multiple interfaces between the tool, the drill pipe, the well fluid and the casing wall.

In order to facilitate the visualization of a well survey log after the logging tool is recovered at surface (desirably in less than 1 hour, 30 minutes, 15 minutes, 10 minutes, 5 minutes or less than 1 minute), by means of a method of constructing a 3D model of the well bore trajectory with superimposed casing segments containing dimensional data is useful. In one aspect, the casing segments are distinguished with a color scheme or similar to enable unspecialized crew to quickly identify worn out or damaged segments of the casing. In one aspect, the method would including providing automated well integrity calculations based on API (American Petroleum Institute) specifications, to reduce the risk of user misinterpretation.

In one aspect, there is provided a method and apparatus of dropping an untethered casing and bore hole logging tool down the well where it desirably will land and deploy inside a landing/catcher sub on top of the bottom hole assembly. The untethered logging tool desirably uses a special ultrasound imaging technique to perform casing and bore hole dimensional measurements through the landing/catcher sub and use a positioning system to determine its location and orientation inside the wellbore. The untethered casing and bore hole logging tool is desirably recovered at surface when the drill string is pulled out of hole, and the stored data is desirably downloaded from the logging tool memory. The stored data is desirably then processed to be visualized in a 3D model of the well bore containing the casing and borehole survey data.

In one aspect, the method and apparatus do not utilize direct access to the well bore. In one aspect, the apparatus and method desirably overcome the difficulty of performing ultrasound measurements through the landing/catcher sub in the drill string by pressing transducers against the landing/catcher sub creating an intimate contact between the logging tool and the landing/catcher sub.

In one aspect, there is provided an untethered casing and bore hole survey logging tool which desirably can be dropped inside a drill string to perform surveys in connection with drilling operations without the need to clear the borehole for drill pipe or any other tubing, prior to the survey. The logging tool desirably will not require a stand-alone intervention in the wellbore like conventional wireline deployed logging tools, as its intention is to piggyback on the pull out or tripping of drill pipe to perform the casing and bore hole survey. The logging data desirably will be stored in the local memory and downloaded to a Laptop/PC or Tablet when the tool is recovered at surface for processing the stored data. The processed data desirably can be visualized in an interactive 3D model of the wellbore showing casing integrity and other bore hole data.

The details of one or more implementations of the subject matter of this disclosure are set forth in the accompanying drawings and the description. Other features, aspects, and advantages of the subject matter desirably will become apparent from the description, the drawings, and the claims.

In one aspect there is a method for measuring the thickness of casing in a wellbore and/or analyzing the inner surface of the cased or non-cased wellbore incorporating the above features. In another aspect there is an apparatus for measuring the thickness of casing in a wellbore and/or analyzing the inner surface of the cased or non-cased wellbore.

BRIEF DESCRIPTION OF THE DRAWINGS

FIG. 3 shows overview of the different echoes arriving to the ultrasonic receiver 204 for the cased well.

B) Matched filter output of: solid line—Casing; dashed line—Ref.

C) Matched filter output of: solid line—Casing with subtracted Ref dash-dot line—Casing with subtracted modeled echoes from the casing inner surface 206 ([T-1-1w-1w-1-R] and [T-1-1w-1w-s-R, T-s-1w-1w-1-R] see FIG. 3). (The later data can be used to extract exact timing of signal arrival from the casing outer surface.)

D) Simulated arrival time of signals from casing inner and outer surfaces for geometry of the experiment.

Figure 6A:
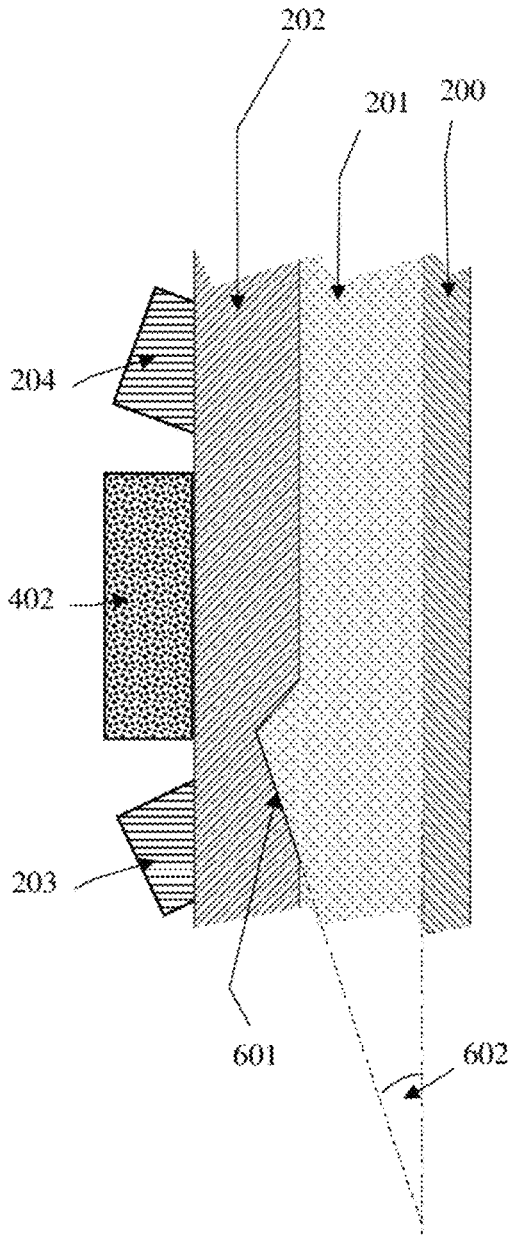
Figure 7:
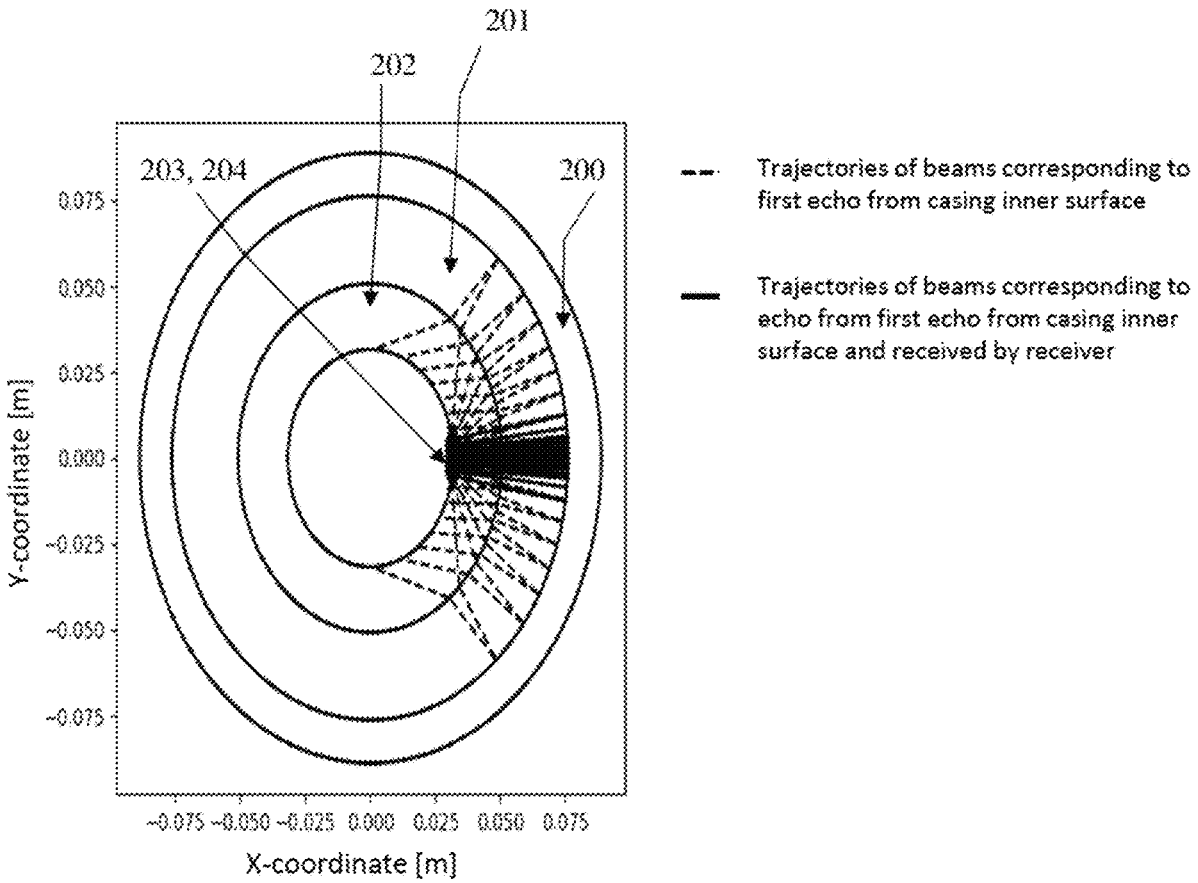
Figure 8:
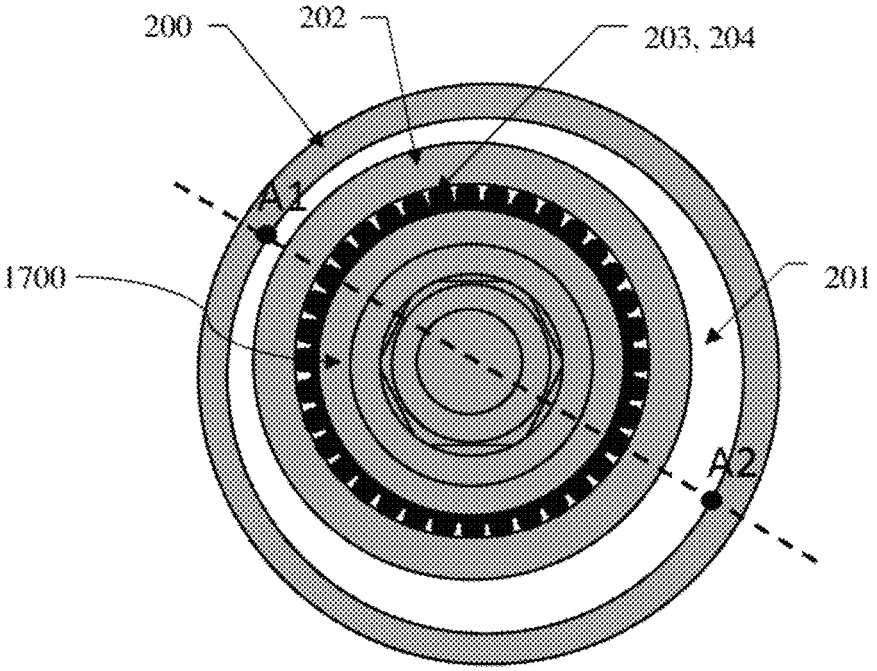
Figure 9:
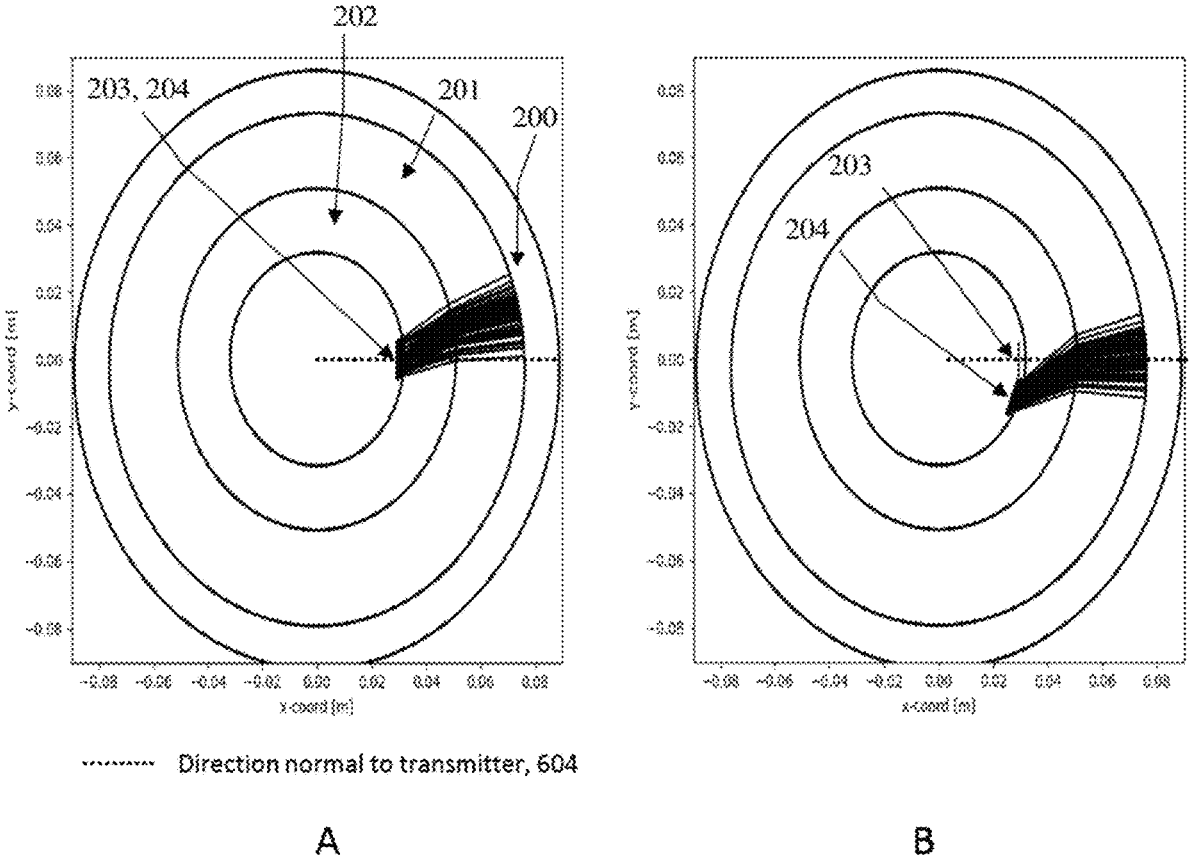

FIGS. 6A and B Illustration of the possible mixed configuration with the use of compressional transmitter and shear receiver and modification of the catcher sub surface FIG. 7 Illustration of azimuthal resolution of the tool and effect of the catcher sub curvature on the ultrasound beams' trajectories FIG. 8 shows eccentrical position of the catcher sub in the casing FIG. 9 Illustration of 3-mm eccentricity of the catcher sub on the measured signal. A) the receiver placed at the same azimuthal location as the transmitter receives echoes azimuthally displaced by approximately 10-15°. B) Neighbor receiver receives signal from the direction opposite to transmitter surface. In such way by use of neighbor receivers it is possible to cover the whole circumference of the casing even in the presence of eccentricity typical for drill pipe inside the casing.

Figure 10:
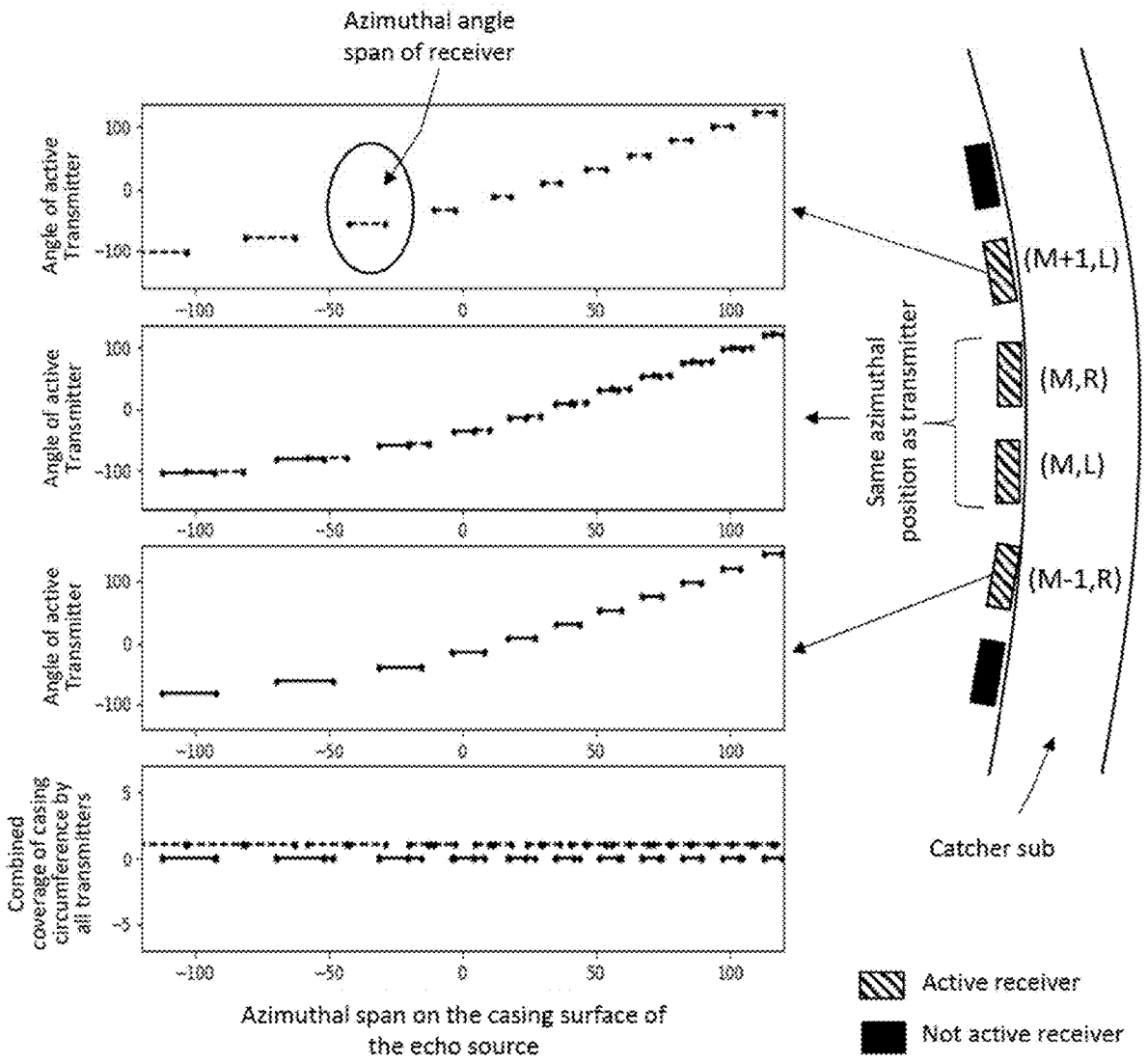

FIG. 10 Model predicted coverage of the casing circumference in the case of 5-mm eccentricity of the catcher sub relative to the casing. Only half circle is shown, the other half is symmetric. (Echoes are received by four active ultrasonic receivers per each active ultrasonic transmitter. Two ultrasonic receivers are place in the same azimuthal location as ultrasonic transmitter but displaced along the well from the ultrasonic transmitter. Two other active ultrasonic receivers are nearest neighbors)

Figure 11:
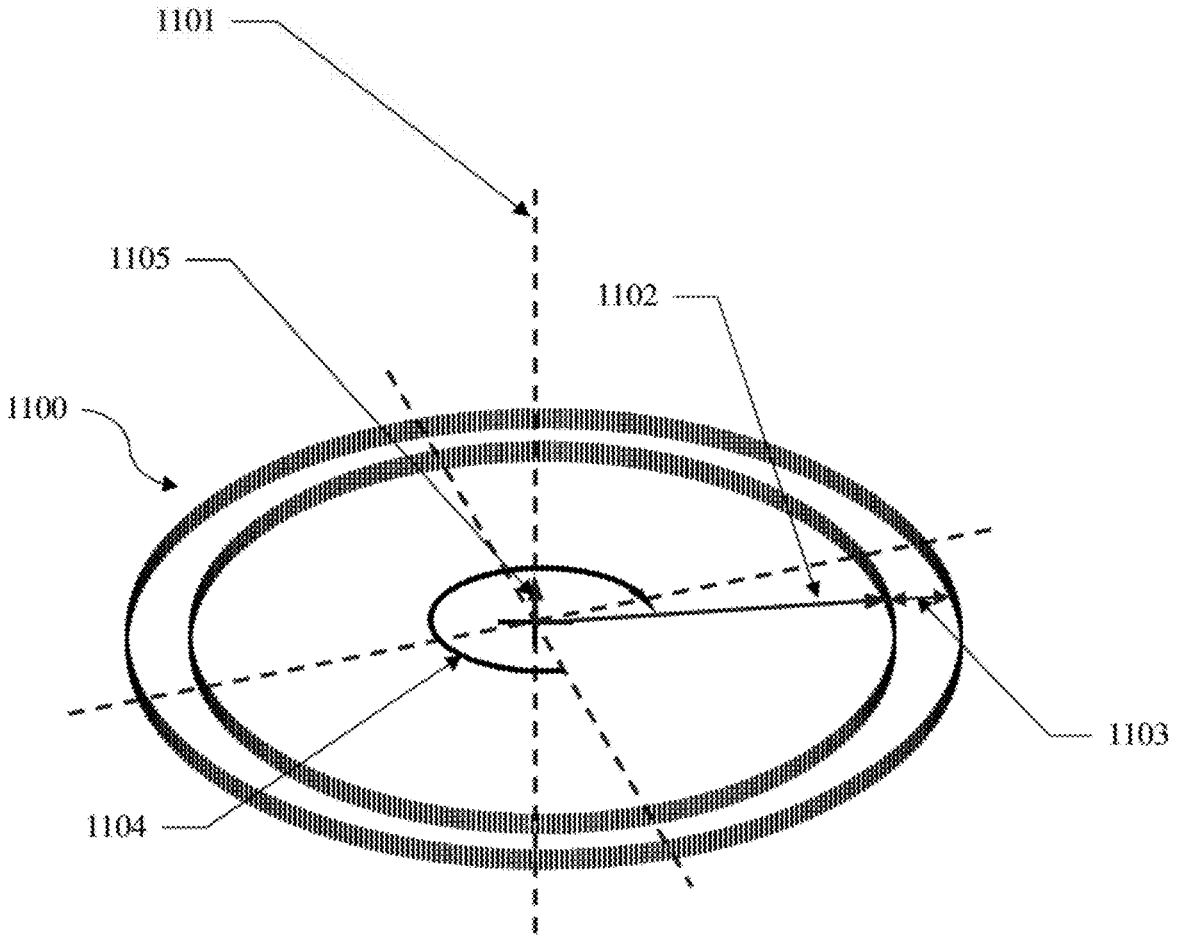

FIG. 11 shows the dimensional data is oriented in a 3D space along the axis of the wellbore.

Figure 12:
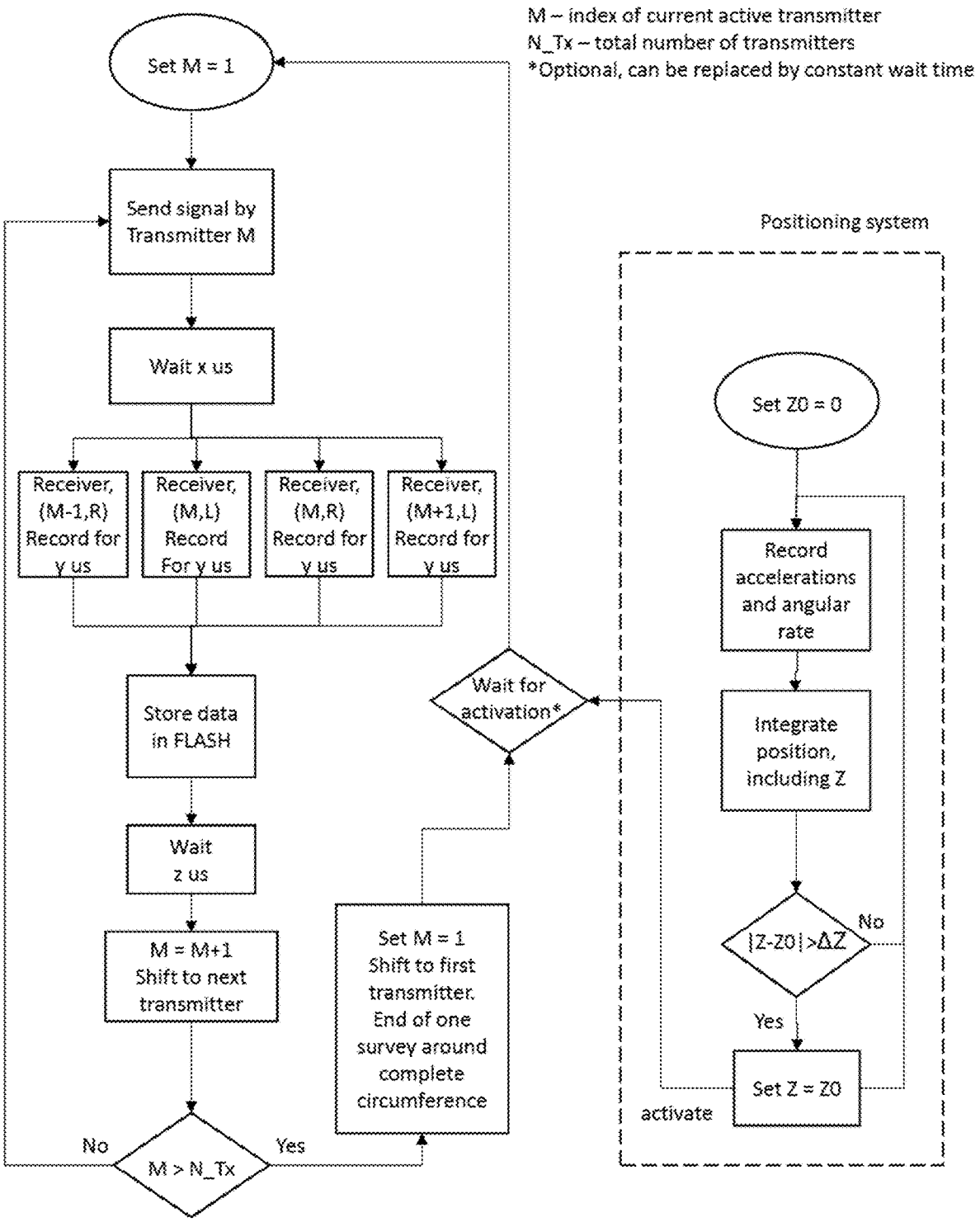

FIG. 12 is a flow diagram of the survey and raw data recording

Figure 13:
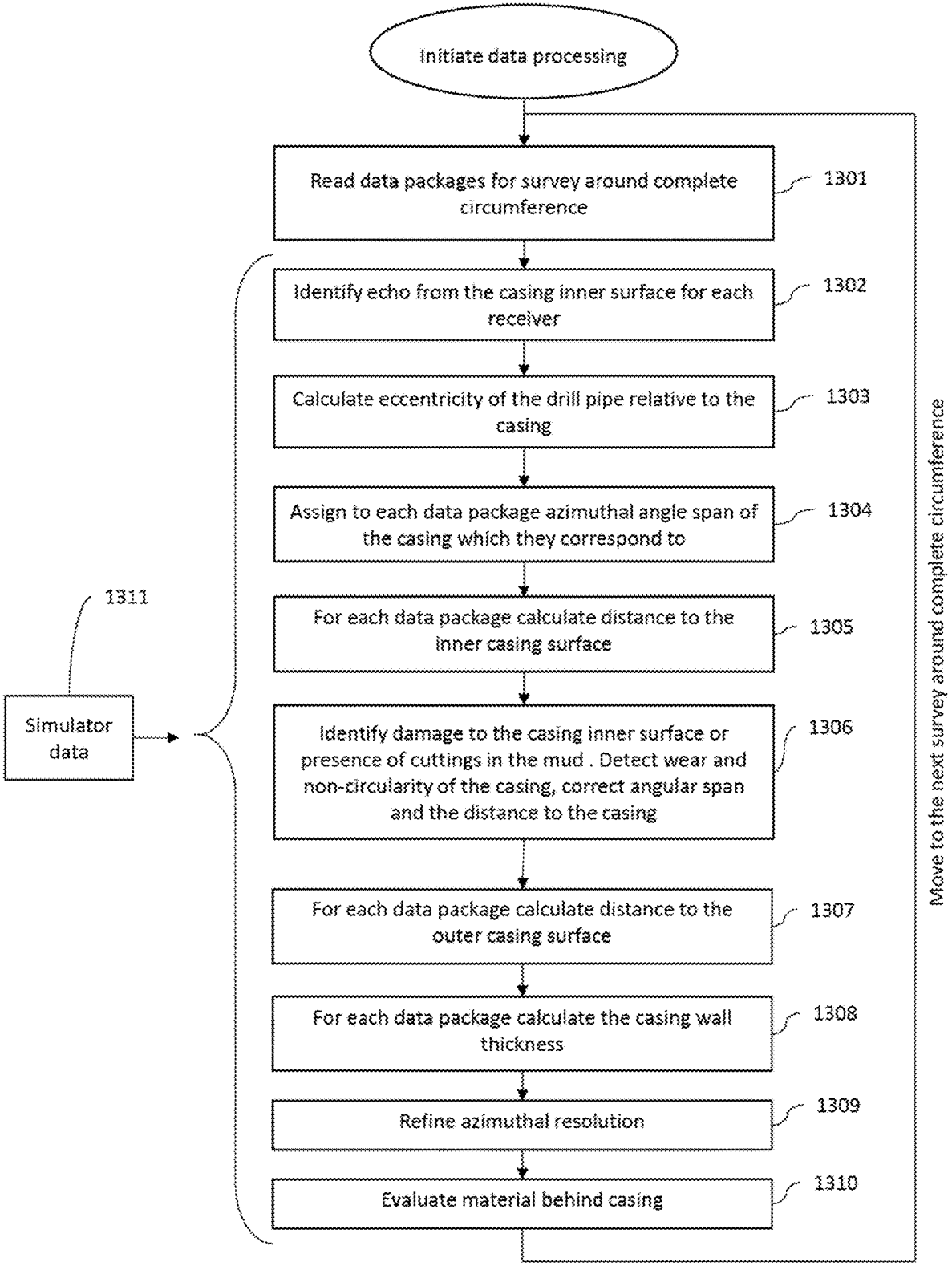

FIG. 13 shows flow diagram of data processing for the cased section of the well. The survey of the uncased portion of the well is done in a similar manner except that echoes come from the borehole surface instead of the casing inner surface and therefore the steps after step 1306 are not used.

Figure 14:
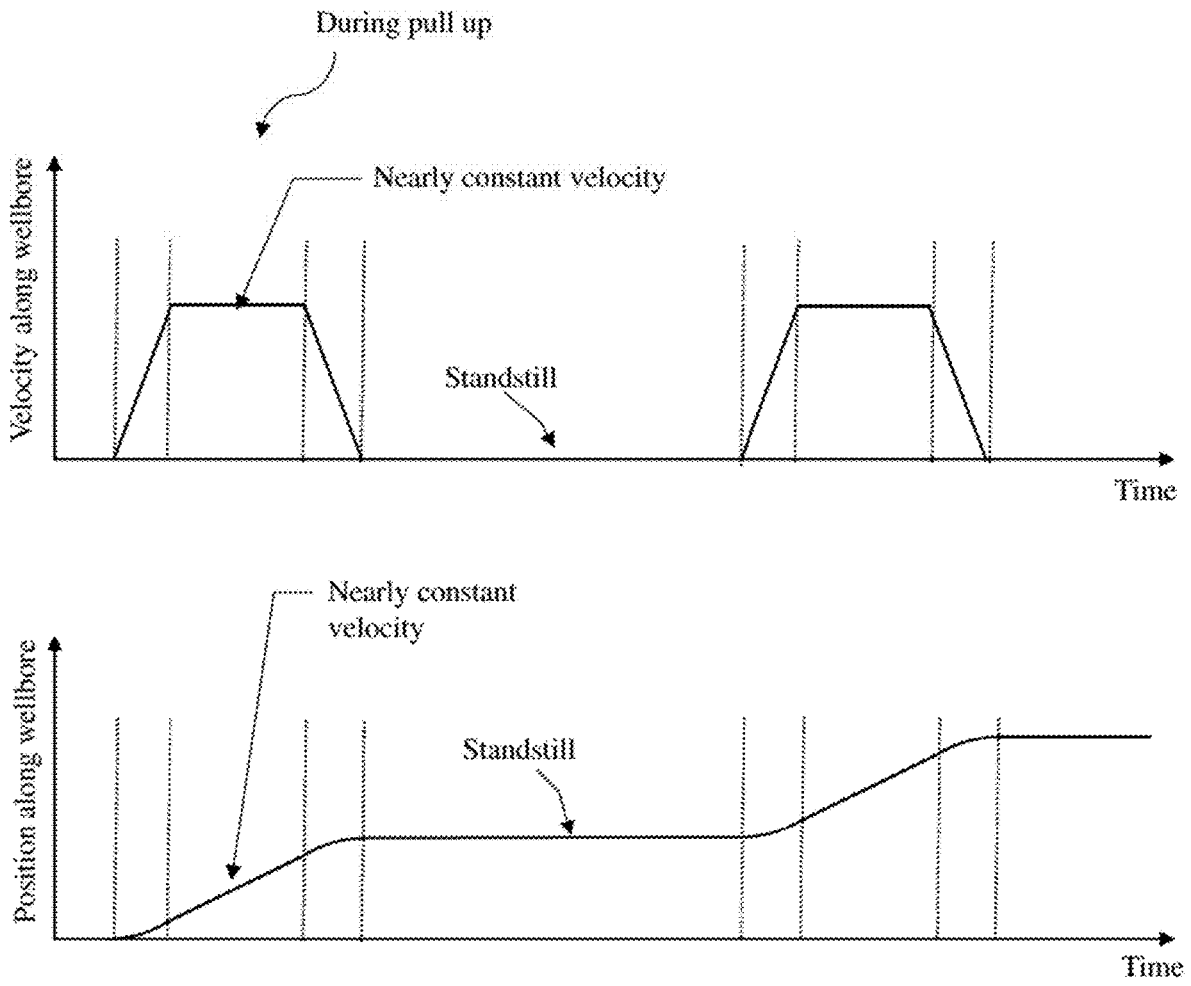

FIG. 14 shows the typical velocity and position in the direction along the wellbore axis 1101 over time during the drill string pull-out.

Figure 15:
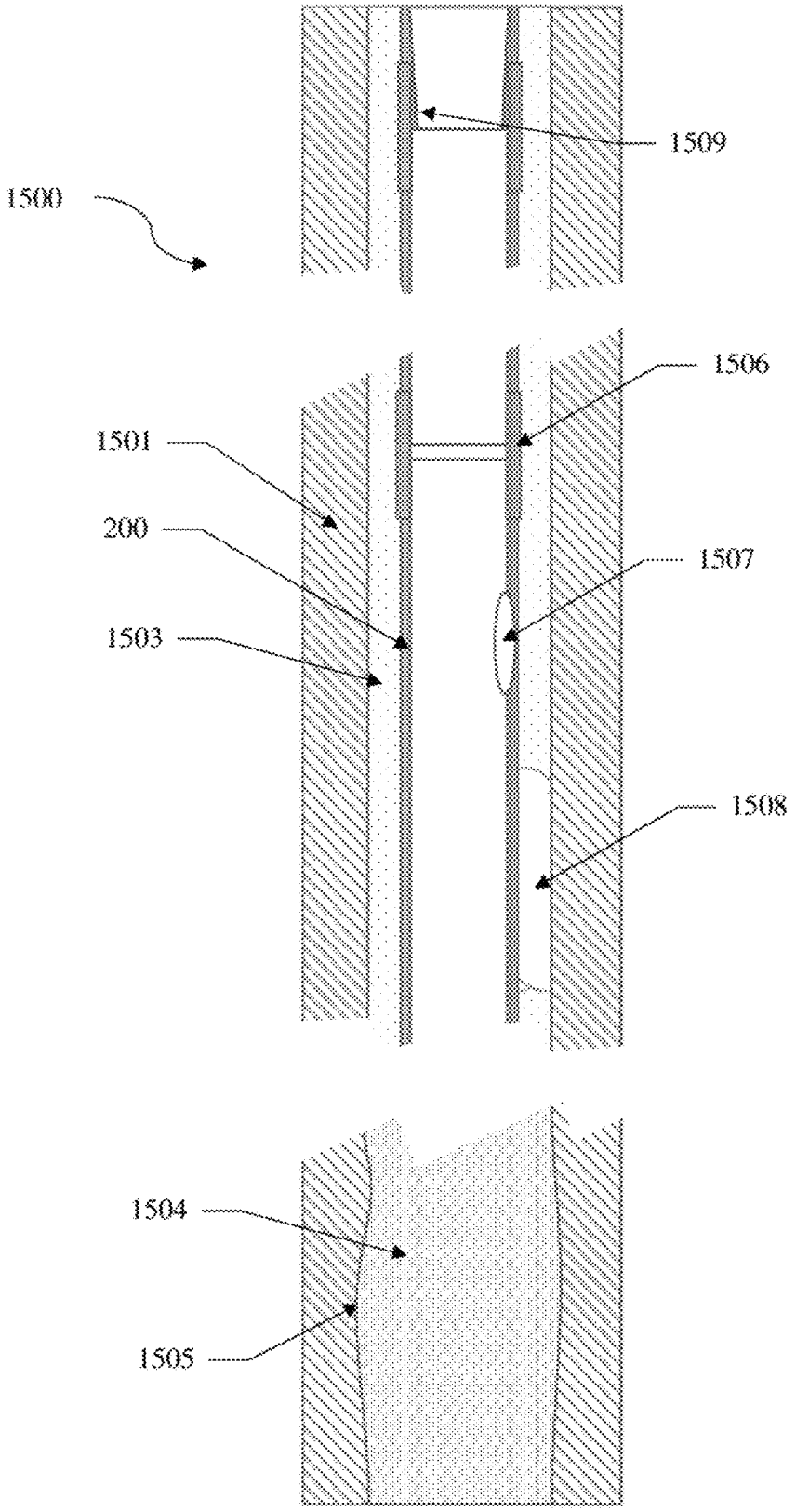

FIG. 15 shows a cased portion and open hole portion wellbore in a formation

FIG. 16 shows Table 7.5 in API Bull. 5C3 "Formulas and calculations for casing, tubing, drill pipe, and line pipe properties"

Figure 17:
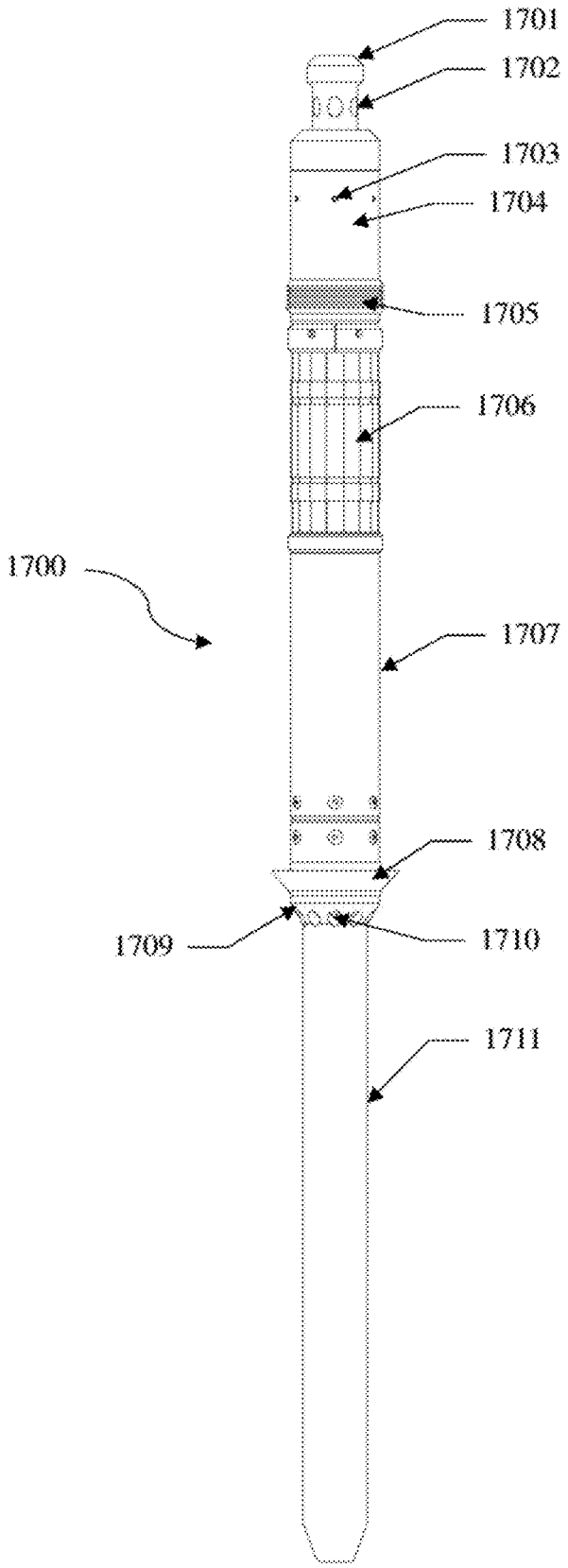

FIG. 17 is an external view of the logging tool.

Figure 18:
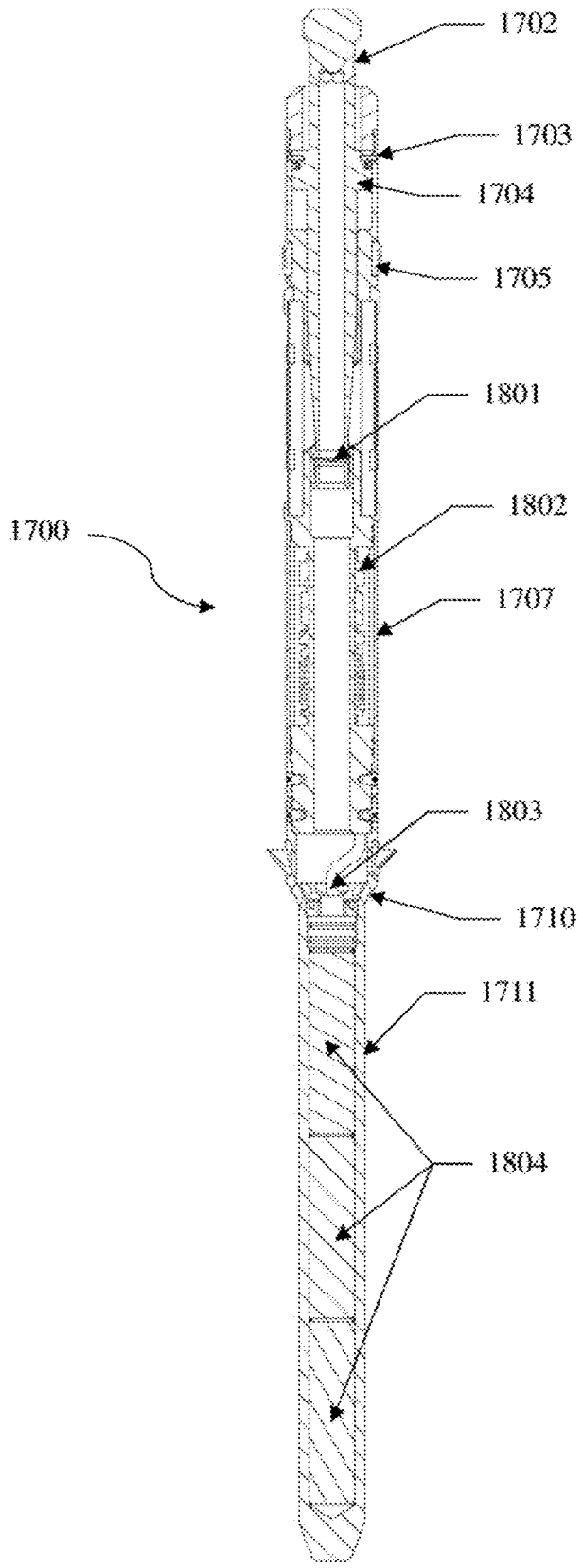

FIG. 18 is a cross-sectional view of the logging tool of FIG. 17

FIGS. 19A and B is a cross-sectional view of an example catcher sub and a landed logging tool.

Figure 20:
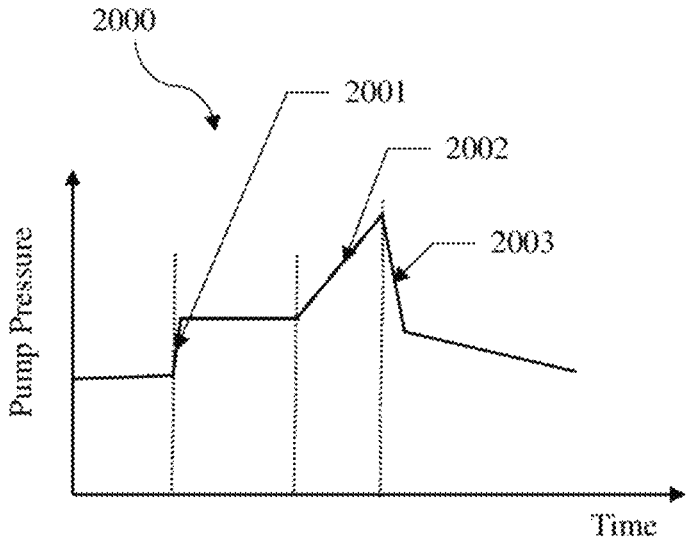

FIG. 20 shows the pressure trace on the circulation pump pressure gauge during deployment.

Figure 21:
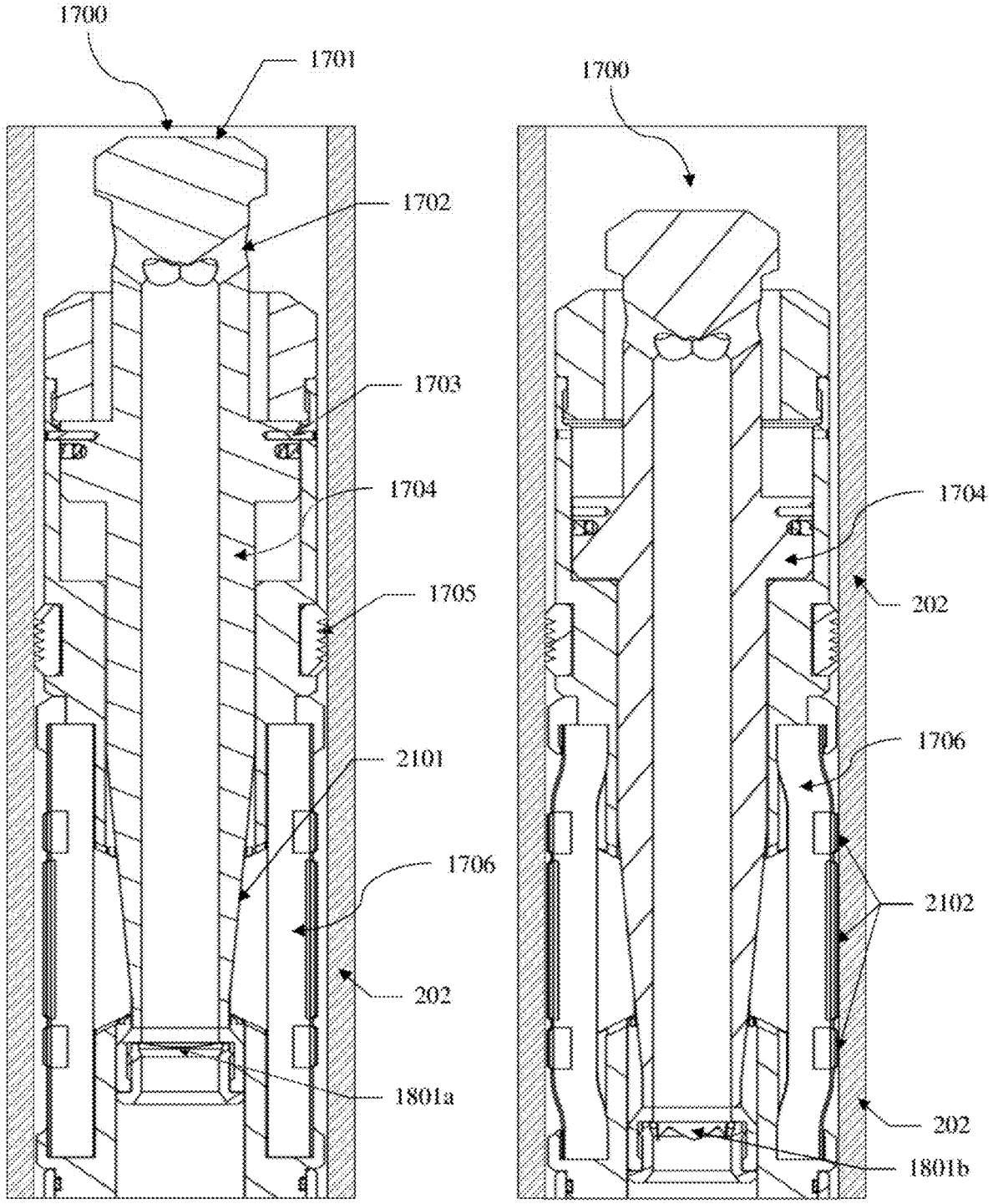

FIG. 21 shows cross sectional enlarged view of the logging tool landed inside the catcher sub (A) prior to the logging tool is deployed and (B) after deployed.

Figure 22:
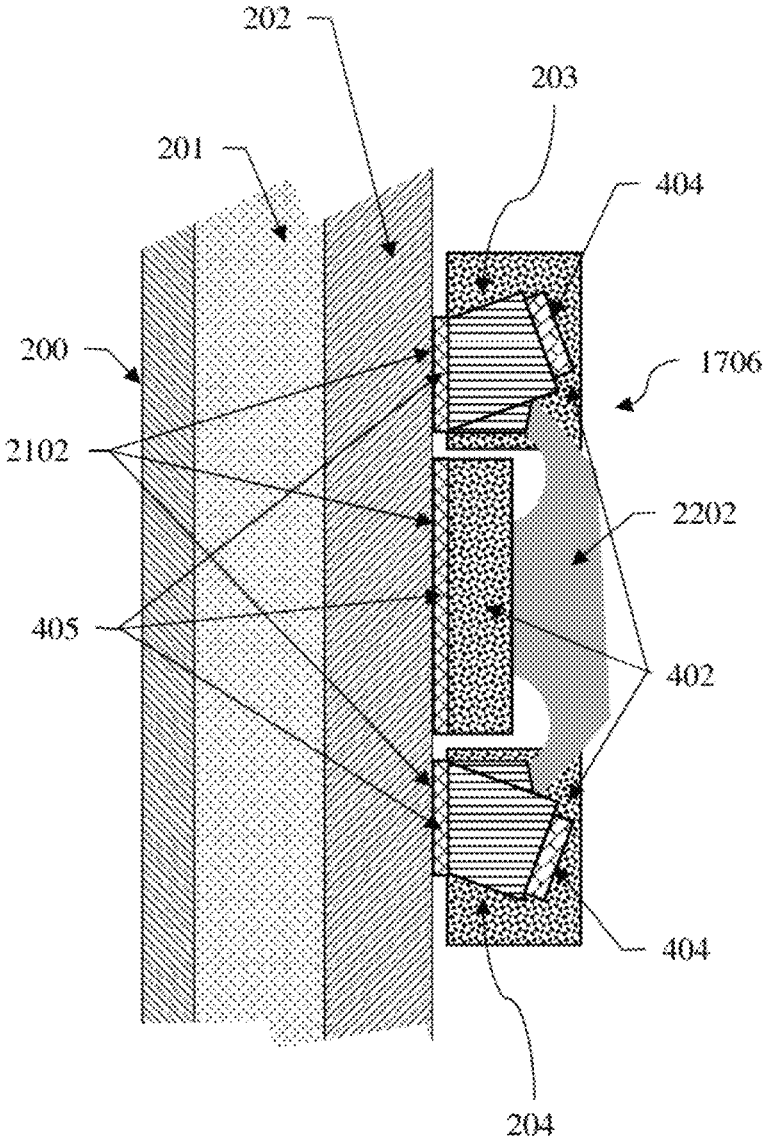

FIG. 22 shows a cross section view of an embodiments of a transducer arrangement and an absorbent/deflector when in contact with the catcher sub inner surface.

Figure 23:
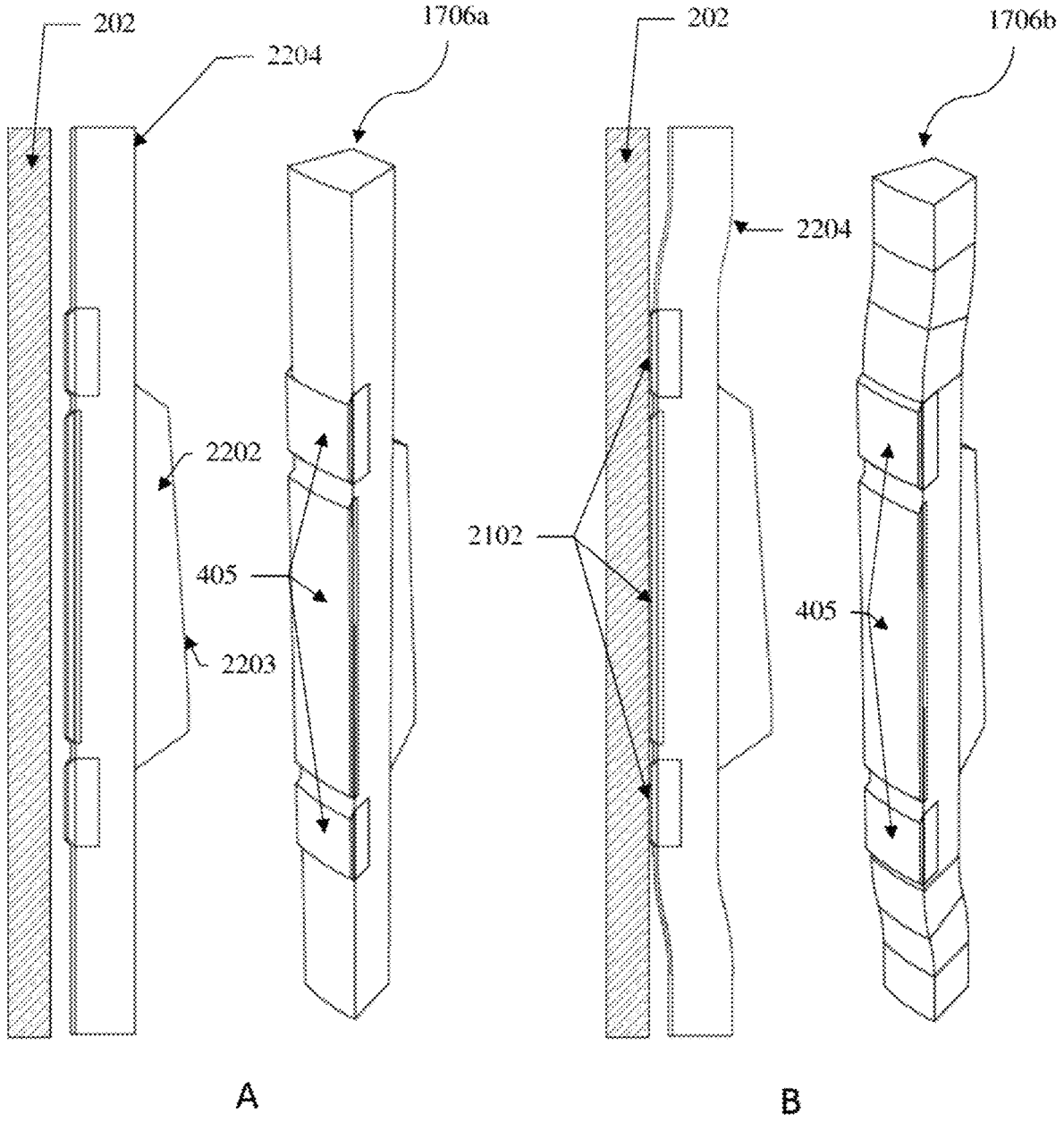

FIG. 23 shows an embodiment view of an extendable ultrasonic transducer shoe.

Figure 24:
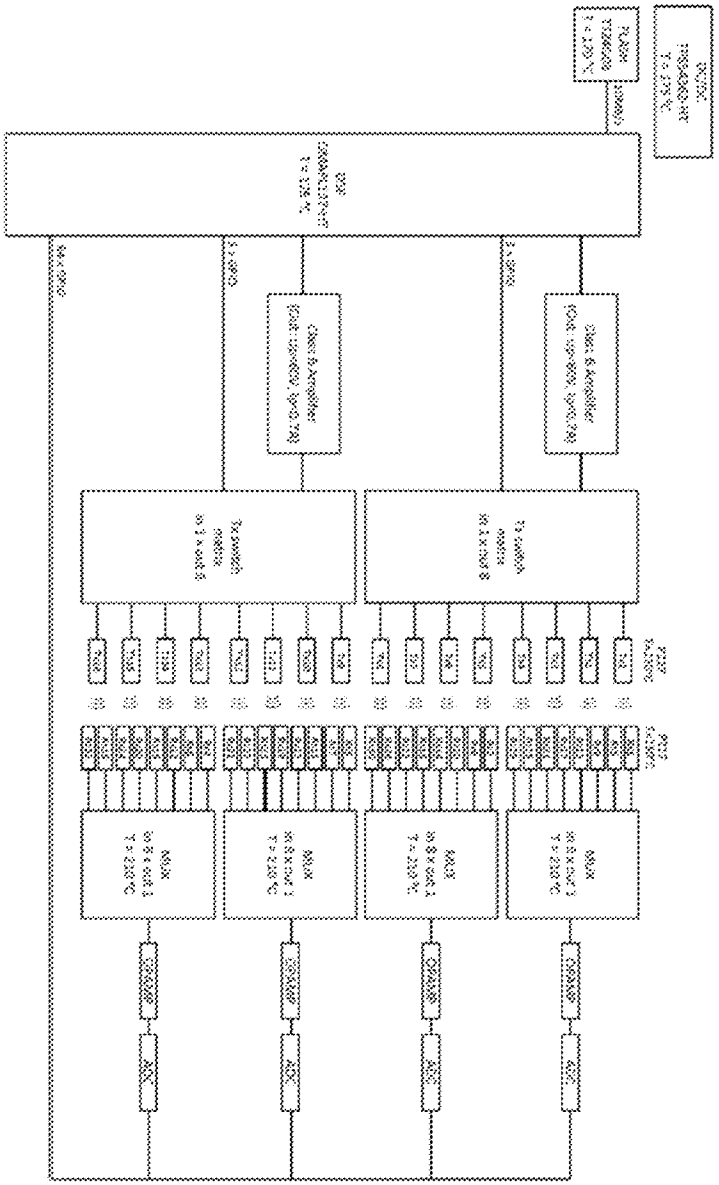

FIG. 24 shows electronics scheme for ultrasound data acquisition.

DETAILED DESCRIPTION

The subject matter described in this disclosure can have particular implementations, so as to realize one or more of the following advantages. A summary of the disclosure is introduced in the first section below.

This disclosure relates to an untethered casing and bore hole logging tool that can be dropped inside the drill pipe or tubing in a wellbore from the deck of a rig, preferably right before the drill pipe or tubing is to be pulled out of hole when the drilling job is complete. The untethered logging tool can further be pumped down the drill pipe to the catcher sub located above the bottom hole assembly. Preferably, the catcher sub is located as close to the bottom hole assembly as possible because this location facilitates logging of the greatest portion of the casing string and bore hole. The catcher sub desirably will catch the untethered logging tool by a NO-GO shoulder that is an ID reduction, which is smaller than the logging tool OD, preventing the logging tool from traveling further down the drill pipe. The logging tool desirably will be retained in the catcher sub and the successful landing desirably will be verified with a pressure increase at the surface mounted pressure gauge on the fluid circulation pump, by the sudden change of the flow restriction for the circulating fluid. The rig crew desirably will at this point increase the pump throttle to further increase the circulation of fluid, thus further increasing the upstream pressure acting on the logging tool. At a first designed upstream pressure, the logging tool desirably will start to deploy its ultrasonic transducer shoes to contact and secure the logging tool to the interior surface of the catcher sub. At a second designed upstream pressure of which the desired contact force is desirably achieved, a sudden change of flow restriction is made which relieves the upstream pressure acting on the logging tool, which results in a pressure drop at the surface mounted pressure gauge on the fluid circulation pump, which desirably will confirm the successful deployment of the logging tool inside and to the interior surface of the catcher sub to the rig crew at surface. The logging tool and the catcher sub are desirably sized and configured to allow continuous flow through the tool to the bottom of the hole, thereby allowing normal well control methods using fluid flow and pressure. When the pressure drop confirmation is made, the rig crew desirably will start pulling out the drill pipe, and the logging tool desirably starts its survey moving up the bore hole. The first portion of the survey desirably will be a bore hole evaluation of the open hole section of the well, before entering into the casing string where the casing survey is made. Typically, the objective of the casing survey after a drilling job is done is to verify that the rotating drill string has not done any damage to the interior sections of the casing, compromising the casings pressure sealing integrity. As the drill string is retrieved to the surface using normal drill pipe retrieving procedures, the ultrasonic transducers within the logging tool deployed inside the catcher sub desirably will transmit and receive ultrasonic signals through the solid wall of the catcher sub, drill pipe or tubing, to perform the casing or bore hole dimensional measurements desirably 360° degrees around the logging tool axis, without compromising the isolation integrity of the drill string. The logging tool also desirably features a positioning system to sense and determine its relative directional data, that is depth, inclination and azimuth, inside the wellbore. As the logging tool records the casing and borehole dimensional data, oriented circumferentially around the axis of the logging tool, the recorded data desirably will enable the construction of a 3D referenced model based on the dimensional measurements and the directional data when the logging tool is retrieved at surface. The 3D model of the well bore desirably will be visualized within a Graphical User Interface (GUI) operated from a PC or tablet. The user can insert casing specifications data such as dimensions and weight class of the casing string from the well plan into this 3D model software. The software desirably can automatically compare the logged casing thickness to the reference thickness, and by color representation (green, yellow, red etc.) highlight the casing sections which has associated wear and damages. The software desirably can calculate the expected collapse and burst pressure of the measured casing segments, thus enabling the user to validate the casing integrity safety factors.

Figure 1:
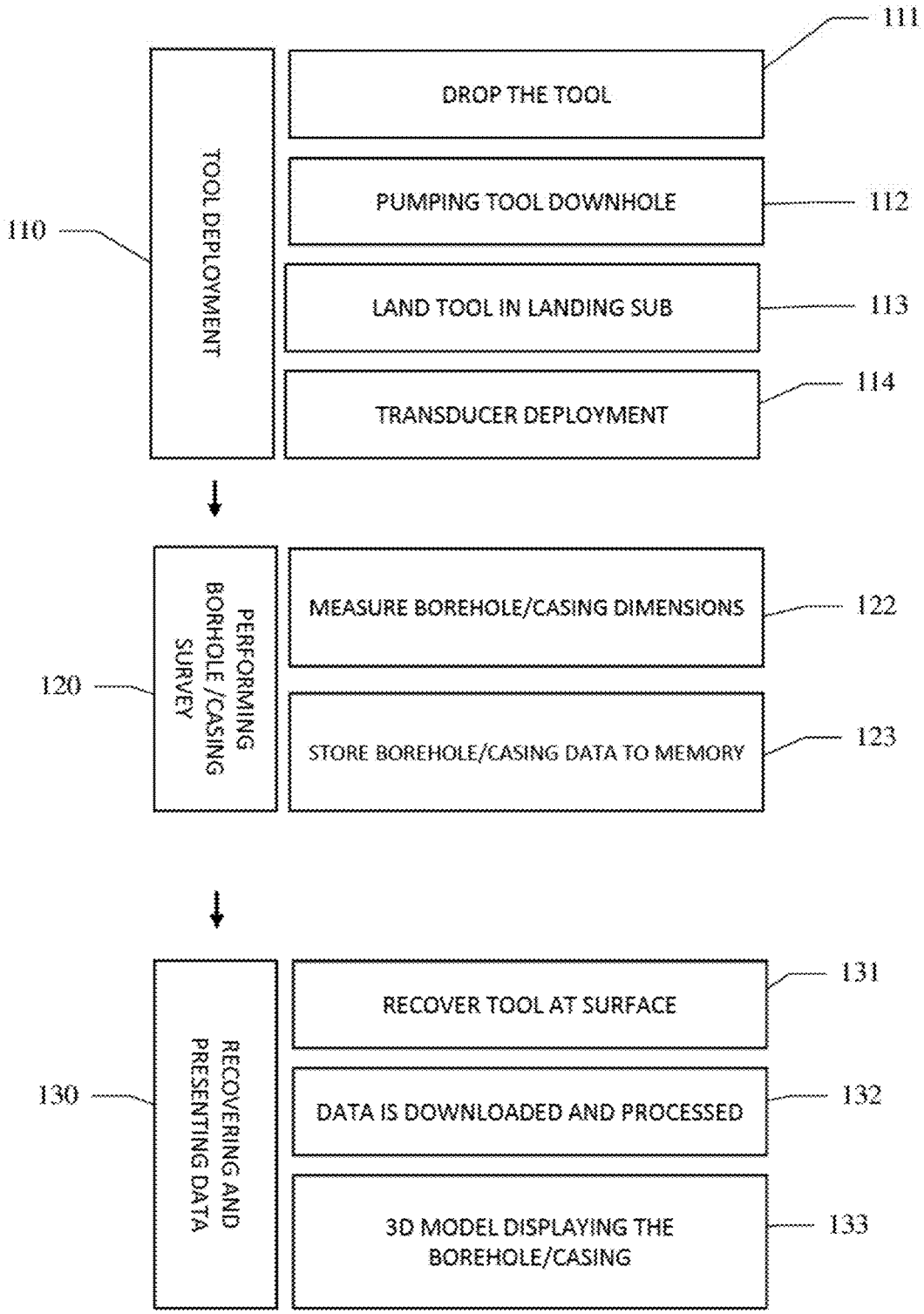
FIG. 1 shows a flow chart describing the method of logging tool deployment.

FIG. 1 shows a flow chart describing a method comprising 3 main stages which is, tool deployment 110 into the wellbore, performing borehole/casing survey 120, and finally recovering and presenting data 130. First step of tool deployment 110 is to drop the tool 111 inside the drill string from the rig floor, then secondly pumping tool downhole 112 by circulating the fluid in the drill string to the bottom of the hole. Third step is to land tool in landing sub 113 which is detected by a pressure increase on the surface pump gauge for the fluid circulation system. The fourth and final step in tool deployment 110 is transducer deployment 114, and this is done by increasing the throttle on the circulation pump to further increase the fluid pressure acting on the downhole tool until a pressure drop is detected, this is further described herein. The second stage is to measure borehole/casing dimensions 122 and then store borehole/casing data to memory 123. The tool desirably will have means of sensing motion or position in the wellbore, and once the drill string being pulled out of hole, the second step desirably will start. The first and second step of the second stage is operating in a continuous loop, where measurements are done, then stored to memory, then repeated until the tool is recovered at surface. The third and final stage is recovering and presenting data 130, where the first step is to recover the tool at surface 131. The second step is to connect a laptop PC or tablet to the tool and download data for processing 132. The borehole/casing data is constructed and arranged in a 3D model using a processor and outputs such as a screen, displaying the borehole/casing 133 dimensions and well bore trajectory. Further post-processing of the borehole/casing data is described above.

Figure 2:
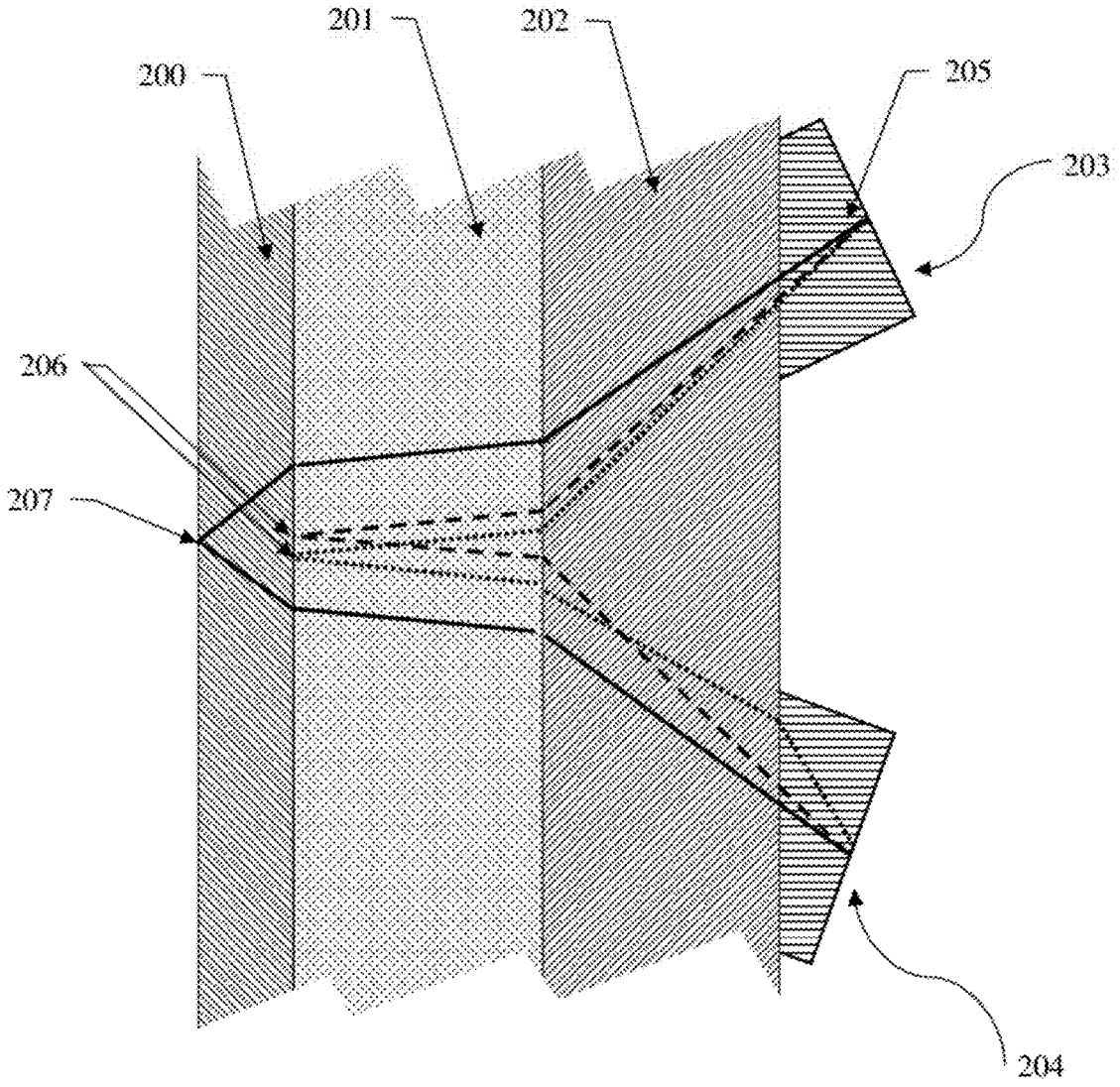
FIG. 2 shows a simplified model view of the ultrasonic signals coming from the inner and outer surface of the casing as ray traces.

The measurement principle for the disclosed invention for determining the casing or borehole dimensions can in some implementations be based on a pulse echo or pitch catch methods with time/distance calculations from the arrival time of ultrasonic echoes. In this disclosure, pulse echo method is a configuration in which the ultrasonic transmitter and receiver are collocated. FIG. 2 shows a simplified sketch model of the ultrasonic transducer arrangement for a pitch catch method and a section view of one specific implementation, comprising a catcher sub 202, well fluid 201 and casing 200. An ultrasonic signal 205 is transmitted from one ultrasonic transmitter 203, to one or several ultrasonic receivers 204. Each ultrasonic signal 205 upon interaction with interface creates at least one transmitted and one reflected wave, however, at a solid-solid interface the number of new waves is at least four. As results, many echoes with variable amplitude and phase are generated in a given geometrical configuration (FIG. 2) and it is close to impossible to track ultrasonic rays paths without advanced simulation tools and it is difficult, to illustrate correctly waves propagation in a simple manner. For illustration, the ultrasonic signal 205 is simplified as a ray traces through the different layers (that is catcher sub 202, well fluid 201 and casing 200) and two echoes from the casing inner surface 206, and one from the casing outer surface 207 are shown in FIG. 2. The two echoes from the casing inner surface 206 can be [T-1-1w-1w-1-R], and [T-s-1w1w-1-R, T-1-1w-1w-s-R] and the echo from the casing outer surface 207 can be [T-1-1w-1-1-1w-1-R] (see FIG. 3 for the explanation of the path of echoes and definition) such echoes represent the main echoes of interest to measure the casing inner and outer diameter in the case when compressional piezoelectric elements are used to transmit signals.

The distance measurements are done by transmitting short pulses or a frequency sweep by the ultrasonic transmitter 203 and receiving the reflected signals. The use of frequency sweep is easier than the use of short pulses in the presence of noise and long-lasting reverberations in the catcher sub 406 (discussed in section [0013]). Only the use of the frequency sweep is described below for brevity, but the same method can also be applied for short pulses. Using frequency sweep, the matched filter is used for detecting echoes, reflections of ultrasound from the different interfaces, which consist of the following steps:

1) Send frequency sweep from ultrasonic transmitter 203 which is the reference signal. The reference signal is the actual signal sent by the ultrasonic transmitter 203, which is frequency sweep modified by the transfer function of the ultrasonic transmitter 203

2) Record signals measured by ultrasonic receiver 204 over certain time window (see for example FIG. 5A)
3) Run recorded signal through a matched filter which calculates the correlation of the delayed reference signal with recorded signal to detect presence of the reference signal in the recorded signal.

Peaks in the output of the matched filter showing detection of the reference signal in the recorded signal represent arrival of different echoes. To resolve different signals, it is desirable that echoes (peaks) from the different interfaces are separated in the time domain. An overview of the casing echoes is given in FIG. 3. The distances to the casing inner and outer surfaces are calculated based on the arrival time of the respective echo to the receiver since the time when the ultrasonic signal was sent by ultrasonic transmitter 203 (FIG. 2). As an illustration, the arrival time of the echo coming from the inner casing surface 206, $t_{206}$, can be estimated as follows:

$$t_{206} = \frac{d_{203}}{C_{203}} + \frac{d_{202,ot}}{C_{202,ot}} + \frac{d_{201,ot}}{C_{201}} + \frac{d_{201,in}}{C_{201}} + \frac{d_{202,in}}{C_{202,in}} + \frac{d_{204}}{C_{204}}$$

where $d_{203}$ is the travel distance inside the ultrasonic transmitter 203; $C_{203}$-is the acoustic velocity in the ultrasonic transmitter 203; $d_{202,out}$,—is the travel distance in the catcher sub 202 between the ultrasonic transmitter 203 and the well fluid 201; $d_{202,in}$-is the travel distance in the catcher sub 202 between the well fluid 201 and the ultrasonic receiver 204; $C_{202,out}$, $C_{202,in}$-is the acoustic velocity in the catcher sub 202; $d_{201,out}$, $d_{201,in}$-is the travel distance in the well fluid 201 between catcher sub 202 and the casing 200; $C_{201}$-is the compressional acoustic velocity in the well fluid 201; $d_{204}$ is the travel distance in the ultrasonic receiver 204; $C_{204}$—is the acoustic velocity in the ultrasonic receiver 204. The acoustic velocities $C_{203}$, $C_{202,out}$, $C_{202,in}$, $C_{202,in}$ can be either compressional or shear waves.

Figure 4:
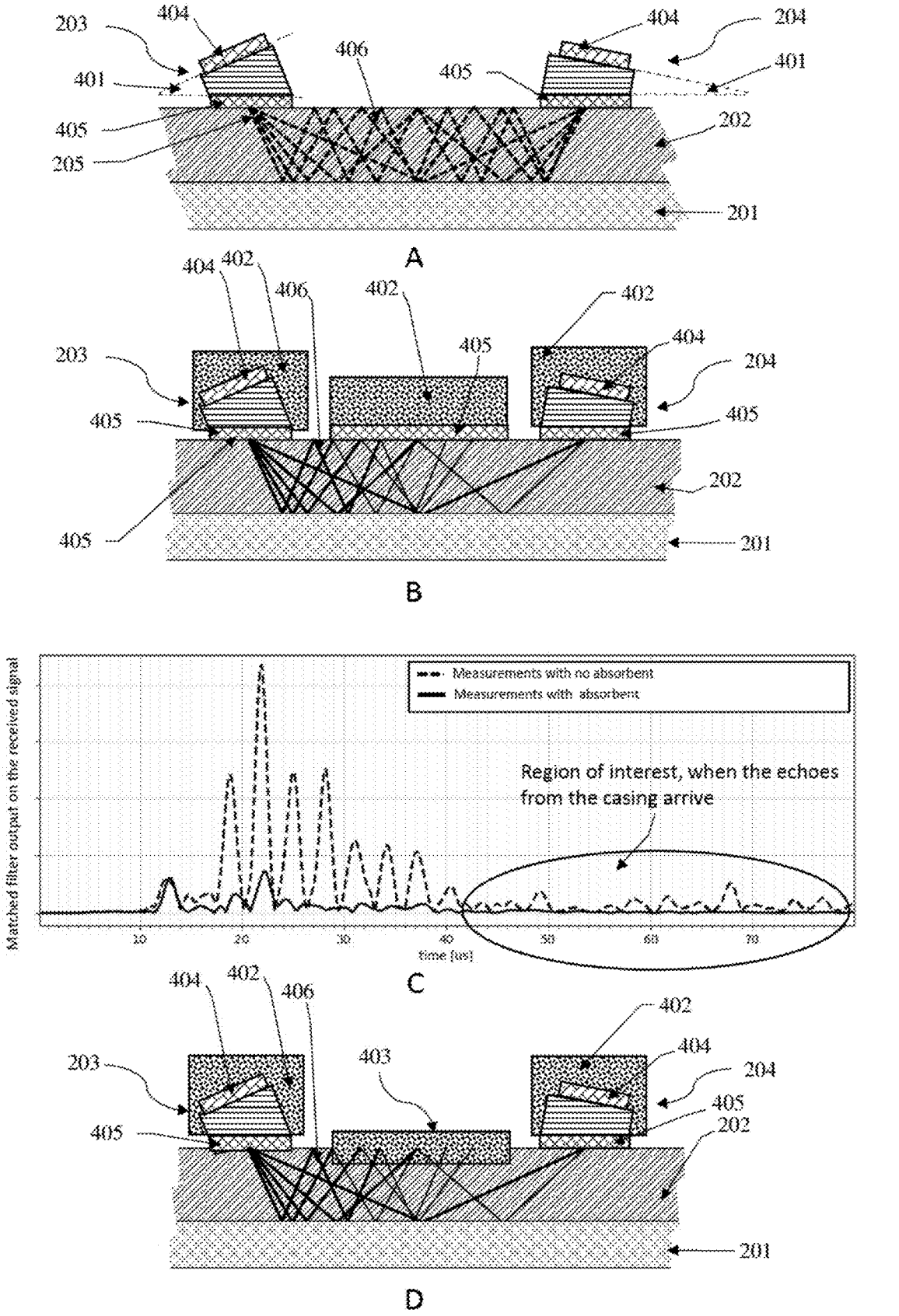
FIG. 4 illustrates a sketch view of a transducer arrangement for the pitch-catch method and reverberations in the catcher sub 406. A) No absorbent, B) absorbent applied against the surface of the catcher sub, C) Experimentally measured reverberations by the receivers D) illustration of the configuration with the ultrasound absorber/deflector being the part of the catcher sub 403.

An echo is always a combination of different ultrasound rays coming with different angles to the surface of piezoelectric element 404 of the ultrasonic receiver 204 (FIG. 4). The simplified equation above only shows a principle and cannot be directly applied to calculate exact arrival time of the echoes. To be able to calculate the distance to the source of the echo from the measured arrival time, an advanced ray tracing or angular spectral decomposition simulator is advantageous to simulate propagation of ultrasound through the logging tool 1700 (FIG. 17) and its surrounding environment. Such advanced models are well developed for ultrasound applications and can be used to generate look up tables with results for each combination of i.e. the varying eccentricity of the drill string in the borehole, the casing inner surface diameter and the casing outer surface diameter, The detailed steps in the analysis are described above.

When performing ultrasound survey through a solid object like the catcher sub 202 surrounded by the well fluid 201, there typically will be a high reflection coefficient, 0.8-0.9, of the ultrasound at the interface between the catcher sub 202 and the well fluid 201. The high reflection coefficient is generally due to the significant difference of the acoustic impedance between the well fluid 201 and the catcher sub 202. Typically, in conventional downhole ultrasound imaging techniques, the outer material of the transducer on the logging tool is chosen to have the acoustic impedance similar to the acoustic impedance of the well fluid 201. Further, the logging tool is moved in relation to the well bore and the signals are transmitted and received through the well fluid. In contrast to the existing methods, the disclosed method desirably provides for the pressing of the ultrasound transducers against the interior surface of the catcher sub 202 to increase the transfer coefficient of the ultrasound from the ultrasonic transducers to the catcher sub 202 by reducing the thickness of the well fluid layer between ultrasound transducers and the catcher sub 202. It has been determined that this should provide enhanced accuracy as opposed to a method in which there is a significant layer, meaning with average thickness of more than 0.8 mm (see section [0045]) of the well fluid present between the ultrasonic transducers and the catcher sub 202. As the drill string is pulled out of hole to facilitate the survey, the logging tool transducers desirably will be kept statically pressed against the catcher sub 202 interior wall during the whole survey, ensuring a good acoustic contact between the logging tool and catcher sub 202. Therefore, it is beneficial to select the material of the transducer in direct contact with the catcher sub 202 with an acoustic impedance similar to the acoustic impedance of the catcher sub 202. In one implementation, the contacting surface of the transducers in contact with the catcher sub can be covered with a ductile material, hereby referred to as contact pad 405 (FIG. 4), with a yield strength lower than the yield strength of the catcher sub 202 material so that optimal acoustic transfer coefficient via shaping of the contact pads 405 to match non-uniform surface of the catcher sub 202 is achieved with the use of lower contact force. The contact between the transducers and the catcher sub 202 is further described above.

When performing ultrasonic survey through the catcher sub 202 is long-lasting and powerful ultrasound reverberations in the catcher sub 406 appearing due to the significant difference in acoustic impedance between the catcher sub 202 and the well fluid 201. The typical magnitude of ultrasound signal received by the ultrasonic receiver 204 in response to the echoes from the casing inner surface 206 is approximately 10 times weaker than the magnitude of the signal sent by the ultrasonic transmitter 203 and the typical magnitude of the echo from the casing outer surface is approximately 100 times weaker than the magnitude of the signal sent by the ultrasonic transmitter 203. Desirably, means are provided to suppress the reverberations in the catcher sub 406, so that reverberations arriving at the ultrasonic receiver 204 at the same arrival time as echoes of interest from the casing will facilitate detection of the timing of echoes from the casing 200. One way to suppress the reverberations in the catcher sub 406 is to use ultrasound transducers aligned at a non-perpendicular angle to the catcher sub 202, i.e., such that maximum of the ultrasound energy is sent at a non-perpendicular angle to the catcher sub 202 inner surface and desirably at a non-perpendicular angle with respect to the longitudinal axis of the casing 200 such that reverberations propagate away from the location of ultrasonic transducers over time. Desirably, the non-perpendicular angle is at least 1° but less than 87° from perpendicular, see section [17] and [0018] for more detailed specifications. This can be achieved by i.e., inclining the piezoelectric element 404 transmitting ultrasound waves at a non-perpendicular angle to the catcher sub 202 (see FIG. 4A). Desirably, the non-perpendicular angle is at least 1° but less than 87° from perpendicular. It has been determined that this can further be improved by pressing a ultrasound absorbent/deflector 402 against the catcher sub 202 surface to absorb or deflect away the ultrasound waves inside the catcher sub 202 (reverberations). A good acoustic coupling between the ultrasound absorbent/deflector 402 and the catcher sub 202 increases the efficiency of the reverberation suppression. In an implementation of a pitch-catch configuration, the ultrasound absorbent/deflector 402 desirably can be placed between the ultrasonic transmitter 203 and ultrasonic receiver 204 (see FIG. 4B). In addition, the transducers can incorporate a ultrasound absorbent/deflector 402 as part of the transducer backing (see FIG. 4B), this is especially suitable for the pulse echo method of measurements in which there is limited or no place for the ultrasound absorbent/deflector 402 in between the collocated ultrasonic transmitter 203 and ultrasonic receiver 204. It is believed that the best effect is obtained when both the piezoelectric elements 404 are oriented at a non-perpendicular angle to the catcher sub 202 interior surface and the longitudinal axis of the catcher sub and/or casing 200 and the ultrasound absorbent/deflector 402 is used. In one embodiment the ultrasound absorber/deflector 402 can be of material with properties described above. FIG. 4C shows experimental evidence of absorbent efficiency to decrease magnitude of the reverberations in the catcher sub 406.

Unlike 7,913,806 (Pabon) where an absorbent material is used to attenuate ultrasound travelling from the first transmitting transducers to the receiver transducer inside the logging tool enclosure; an ultrasound absorbent/deflector 402 is used to reduce the reverberations in the catcher sub 406 and especially those which arrive at the ultrasonic receiver 204 at the same time as the echoes from the casing 200 or the borehole. To efficiently absorb reverberations in the catcher sub 406, the ultrasonic absorbent/deflector 402 should desirably have acoustic impedance similar to the impedance of the catcher sub 202 to maximize the transfer of ultrasonic energy from the catcher sub 202. Further, the internal structure of the ultrasonic absorbent/deflector 402 should desirably be non-uniform to efficiently scatter ultrasound waves with the characteristic size of non-uniformities larger than at least 5%, or better 20%, of the wavelength. Non-limiting example of such absorbent materials can be a lead alloy filled with tungsten particles. Other examples can be tin, aluminum, copper, or heavily loaded epoxy resin with tungsten particles, and the concentration of tungsten or similar heavy particles should desirably be ~50% by volume. If the ultrasound absorbent/deflector 402 material is a lead alloy, the low yield strength of the lead enables low contact pressure to provide a good acoustic contact with the catcher sub 202. Thus, the use of separate contact pads 405 between the ultrasound absorbent/deflector can be avoided.

To illustrate the desirable properties of the ultrasound absorbent/deflector, consider the catcher sub 202 with outer diameter approximately 4.75" and with inner diameter 2.5" and the casing 200 with the inner diameter of approximately 6", the echoes from the casing 200 desirably will arrive to the ultrasonic receiver 204 after approximately 40 μs from the firing of the ultrasonic transmitter 203. The reverberations in the catcher sub 406 reaching the ultrasonic receiver 204 at the same time as the echoes from the casing 200 would be at least 3 times reflected between the inner and outer diameter of the catcher sub 202. Thus, it is possible to design an ultrasonic absorbent/deflector 402 in such way that the reverberations in the catcher sub 406 would interact with the ultrasound absorber/deflector 402 at least 3 times before reaching the location of the ultrasonic receiver 204. For example, if the ultrasonic absorbent/deflector 402 reduces the reverberations in the catcher sub 406 by 70% in each interaction, the total amplitude of reverberations in the catcher sub 406 reaching the ultrasonic receiver 204 desirably will be reduced by at least 97%. In another aspect instead of using the ultrasound absorber/deflector 402, attenuation of the reverberations in the catcher sub 406 is done using the ultrasound absorber/deflector being the part of the catcher sub 403 shown in the inner surface of the catcher sub 202 (FIG. 4D), thus reducing the complexity of the logging tool 1700. Additionally, modifications of the outer diameter or the inner diameter of the catcher sub 202 can be used to deflect the reverberations in the catcher sub 406 away from the ultrasonic receiver 204, in addition to the round inner surface of the catcher sub scattering waves away from the receiver and sender.

Figure 5:
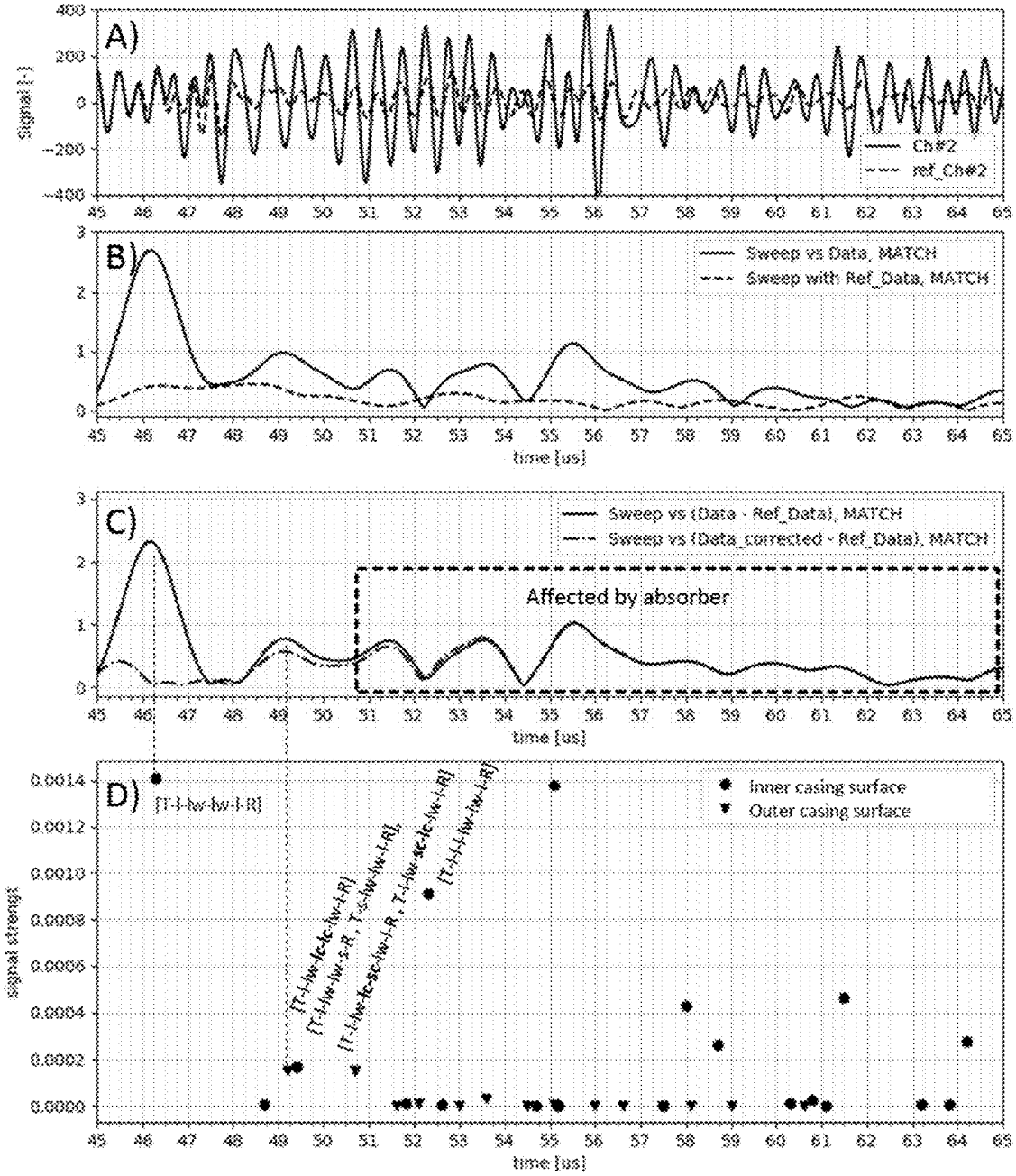
FIG. 5 Received raw signal: solid line—with 10 mm casing 25 mm space between drill pipe and casing (Casing), dashed line—calibration data without casing (Ref).

The resolution of peaks in the matched filter output is defined by the bandwidth of the sent ultrasound frequency sweep. FIG. 5B shows an example, of the matched filter output for the measurements (FIG. 5A) done using compressional ultrasonic waves in which echoes [T-1-1w-1w-1-R], [T-1-1w-1w-s-R, T-s-1w-1w-1-R] and [T-1-1w-1-1-1w-1-R] of the main interest are marked (illustrated in FIG. 2 and explained in FIG. 3). The amplitude of [T-1-1w-1w-1-R] (the echoes coming from the inner casing surface 206 seen in FIG. 2) is approximately 10 times stronger than [T-1-1w-1-1-1w-1-R] (the echo from the outer casing surface 207). Also, the second echo from the inner surface of the catcher sub, [T-1-1w-1w-s-R, T-s-1w-1w-1-R] overlaps with [T-1-1w-1-1-1w-1-R] in time. The half-width of the peaks on the timescale produced by the matched filter in the response to the signal matching the reference is approximately equal to the inverse bandwidth of the frequency sweep used. Therefore, either large bandwidth should desirably be used to resolve echoes with approximately equal amplitude separated by 1 μs, i.e., at least 1 MHz bandwidth is desirable (1.5 MHz bandwidth was used in the experiment illustrated in FIG. 5B) or another option is to remove some of the strong echoes after detection or calculating their arrival time to detect the exact arrival time of the weaker echoes such as [1.-1-1w-1-1-1w-1-R]. For example, after detecting the exact arrival time of [T-1-1w-1w-1-R], the arrival timing of [T-1-1w-1w-s-R, T-s-1w-1w-1-R] can be calculated using known compressional and shear wave speeds and known geometry of the catcher sub. Then, the simulated replicas of [T-1-1w-1w-1-R] and [T-1-1w-1w-s-R, T-s-1w-1w-1-R] scaled by the measured magnitude of [T-1-1w-1w-1-R] can be subtracted from the recorded data. Example of matched filter response to the signal from which the signal of echoes [T-1-1w-1w-1-R] and [T-1-1w-1w-s-R, T-s-1w-1w-1-R] was removed is shown in FIG. 5C. Afterwards, the arrival time of [T-1-1w-1-1-1w-1-R] (FIG. 3) coming from the casing outer surface can be exactly determined.

Size constraints within the catcher sub 202 make desirable the use of small-size piezoelectric elements 404 for the ultrasonic transmitter 203 and ultrasonic receiver 204 relative to the transmitted wavelength. As a result, the aperture angle of the ultrasonic signal 205 is very wide and the directivity is poor, thus the ultrasonic receiver 204 desirably will sense a large number of echoes from the casing 200 which are partially listed in FIG. 3. A variety of inclination angles of piezoelectric element 401 (FIG. 4) of the transducers can be used for the described method of measurements, however, the inclination angle of piezoelectric element 401 desirably can be optimized to increase the strength of one of the echoes from the casing outer surface, and desirably that echo can be to characterize the casing 200. With the use of the compressional mode piezoelectric element 404 in the ultrasonic transmitter 203 and ultrasonic receiver 204, it is believed that the optimal values of inclination angle of piezoelectric element 401 is less than 40°, or better less than 20° relative to the interior surface and the longitudinal axis of the catcher sub and/or casing 200. which leads to a situation that the compressional echoes

[T-1-1w-1w-1-R] and [T-1-1w-1-1-1w-1-R] (FIG. 3) and mix-mode echo [T-1-1w-1w-s-R, T-s-1w-1w-1-R] (FIG. 3) carry higher energy than pure shear echoes [T-s-1w-1w-s-R] and [T-s-1w-sc-sc-1w-s-R] (FIG. 3).

The same measurement principle can be used with the use of the piezoelectric elements 404 polarized to transmit and receive shear waves. In such applications, the piezoelectric element 404 polarized perpendicular to the direction of the wave propagation sends waves through the contact pad 405 and into the catcher sub 202, and a portion of the sent wave gets converted into compression wave travelling in the well fluid 201 towards the casing 200 where it desirably will create shear wave in the casing 200. The time separation between the shear mode echo from the casing inner surface [T-s-1w-1w-s-R] (FIG. 3) and the shear mode echo from the outer surface [T-s-1w-sc-sc-1w-s-R] (FIG. 3) is approximately 5 μs in contrast to μs for the case of using compressional transducers (FIG. 5C and FIG. 5D) because shear wave speed is almost two times smaller than the compressional wave speed, thus, with the use of shear transducers lower time resolution of the echoes is sufficient, and therefore, it is possible to use narrower bandwidth and lower carrier frequency. With the use of the shear mode piezo elements in the ultrasonic transmitter 203 and the ultrasonic receiver 204, the suitable range of angles for the inclination angle of piezoelectric element 401 is between 33° and 87°, thus, it is possible to transfer significant energy of shear waves into the well fluid 201 and the pure shear echoes [T-s-1w-1w-s-R] and [T-s-1w-sc-sc-1w-s-R] (FIG. 3) carry greater energy than pure compressional echoes [T-1-1w-1w-1-R] and [T-1-1w-1-1-1w-1-R] (FIG. 3).

Figure 6B:
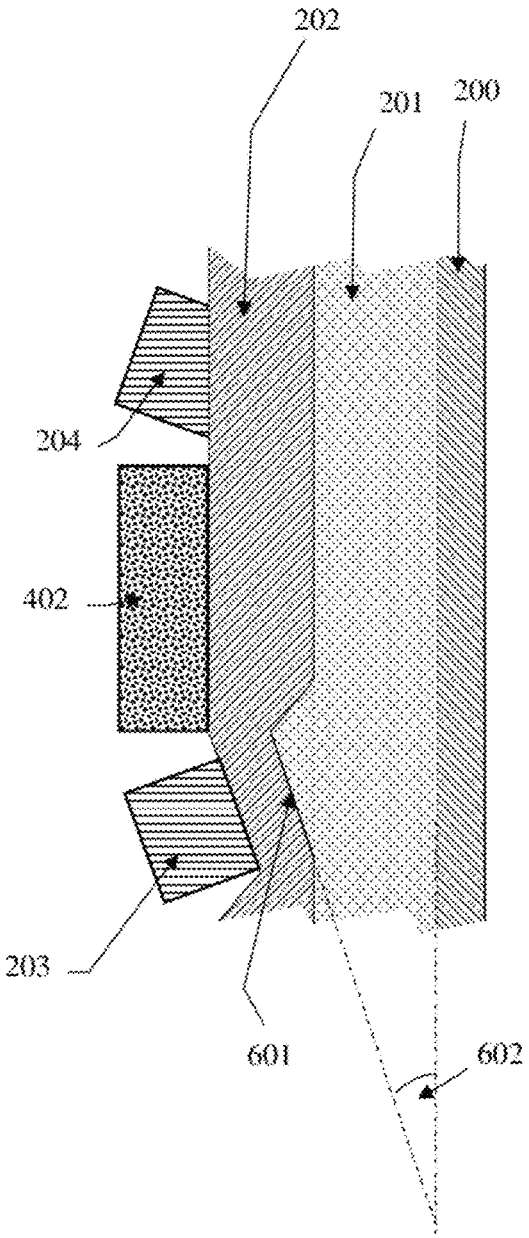

FIG. 6 shows another embodiment which uses a combination of the ultrasonic transmitter 203 transmitting compressional waves and the ultrasonic receiver 204 designed to sense shear waves. Such combination desirably is completed with modification of the outer surface of the catcher sub 202. In a preferred embodiment, the piezoelectric element 404 of the ultrasonic transmitter 203 is oriented normal relative to the inclined surface 601 of the catcher sub 202, thus, maximizing the transfer coefficient of acoustic energy from the catcher sub 202 to the well fluid 201. The inclination angle of the surface for sending ultrasound waves 602 (FIG. 6) should desirably be greater than 15° so that the waves sent with such angle desirably will transfer more energy to the shear waves in the casing 200 than to the compressional waves in the casing 200, and among returned ultrasound signals the echoes [T-1-1w-1w-s-R] and [T-l-1w-sc-sc-1w-s-R] (FIG. 3) desirably will be stronger than compressional echoes [T-1-1w-1w-1-R] and [T-1-1w-1-1-1w-l-1-R] (FIG. 3), and thus, it should be advantageous to detect waves with the ultrasonic receiver 204 designed to receive shear waves. A significant benefit of such configuration is that most of the energy of the reverberations in the catcher sub 406 would be carried by the compressional waves to which the ultrasonic receiver 204 has poor sensitivity.

There are several factors that affect choice of center frequency and bandwidth of the frequency sweep. The center frequency is limited from above by: 1) dissipation of ultrasound waves in the well fluid 201 which increases approximately linearly with frequency; 2) Sensitivity to corrosion or scratches on the surface of the casing and the catcher sub increase inversely proportional to the wave length, i.e., proportional to the wave frequency; 3) shorter wavelength results in a greater variation of the stress-wave phase over the surface of receiving ceramics due to the circular geometry of the surveillance environment. Numerical simulations showed that the carrier frequency should desirably be lower than 1.5 MHz, or better lower than 0.8 MHz. Lower frequency results in stronger signals and absence of blind spots around the casing circumference. Separation of echoes from different sources is easier and the signal to noise ratio is greater when greater bandwidth is used which requires the use of higher center frequencies. The desired bandwidth should desirably be at least 0.05 MHz, at least 0.1 MHz, better more than 0.3 MHz. Thus, the operation frequency range preferably lies between 0.05 MHz and 1.5 MHz.

In conventional bore hole surveys run on wirelines, such as Schlumberger (SLB) UltraSonic Imaging Tool (USIT) some sort of focusing or lobe forming of the ultrasound beam is required to achieve good azimuthal resolution. In the case of ultrasound measurements through the drill pipe with the use of contacting transducers, the azimuthal resolution is affected by the catcher sub 202. The curvature of the catcher sub 202 spreads ultrasound beams in such way that only rays from the casing inner and outer surfaces within certain azimuthal angles are received by the ultrasonic receiver 204, see FIG. 7. I.e., for a 5-mm wide ultrasonic receiver 204 this is approximately 12° which can be satisfactory resolution for the survey.

While the logging tool 1700 is pulled out of hole, the drill string desirably will almost always be positioned eccentric in the bore hole or casing 200. FIG. 8 illustrates an eccentric position of the catcher sub 202 and subsequently the logging tool 1700, with respect to the casing 200 in the wellbore. The eccentricity of the logging tool 1700 and the catcher sub 202 in the bore hole or casing 200 can be reduced with the use of centralizers, downhole devices, for example, equipped with bow springs to keep the catcher sub 202 centralized. The eccentricity can often be limited by the outer diameter of the stabilizers which are typically used during drilling to avoid unintentional sidetracking and vibrations. The stabilizer is ⅛" smaller than the nominal ID of the casing, thus resulting in maximal eccentricity of ⅛" which however can be larger due to the wear. Eccentricity of the logging tool 1700 in the bore hole can have a destructive effect on the ultrasound measurements (FIG. 9A and FIG. 9B), as some portion of the casing are surveyed with finer azimuthal resolution and some are with coarser azimuthal resolution, eccentricity can lead to the appearance of blind spots. The azimuthal span on the casing surface of the echo source changes with the magnitude and direction of eccentricity (FIG. 9A). Blind spots appear when certain ultrasonic receivers 204 receive ultrasound waves with phase changing more than 180° over its surface. To overcome this problem, neighboring ultrasonic receivers 204 azimuthally spaced apart can be used in combination to the ultrasonic receivers 204 placed longitudinally away from the firing ultrasonic transmitter. It is believed to be possible to design the size, position and number of ultrasonic transmitters 203 and ultrasonic receivers 204 so that no blind spots should exist. A non-limiting design example is to use 16 7-mm-wide transmitters in combination with 32 3-mm-wide receivers should allow full coverage of the casing circumference in the case of 5 mm eccentricity with angular resolution 5°-20°. FIG. 10 show which receiver desirably will cover which azimuthal angle span, per each pulse or sweep sent by one ultrasonic transmitter 203, 4 receivers are active. Different combinations of ultrasonic receiver 204 and ultrasonic transmitter 203 positions, sizes and number can be used to achieve optimal coverage and resolution.

In one preferred embodiment, several ultrasonic transmitters 203 arranged with corresponding ultrasonic receivers 204 separated azimuthally apart by at least 60° can be fired simultaneously, as this desirably will facilitate a faster pull out speed of the drill pipe and logging tool 1700 from the bore hole, while still maintaining the higher measurement resolution compared to firing single ultrasonic transmitters 203 separately.

As the drill pipe is pulled out of hole, the positioning system in the logging tool 1700 desirably will provide the relative position in the wellbore similarly as the survey is performed. The data set containing survey and positional data desirably will be stored to the logging tool 1700 memory. A flow chart procedure for one specific implementation of the invention is shown in FIG. 12. In this specific implementation of the invention, the logging tool design example with 16 transmitters and 32 receivers is used, however the same flow chart procedure can be used for different combinations and arrangements of the invention. At stage 2, performing borehole/casing survey 120 seen in FIG. 1 is initiated, the first ultrasonic transmitter (M) at relative azimuthal angle 0° is sending a frequency sweep signal. After x microseconds, the four ultrasonic receivers 204, two receivers (M,L) and (M,R) (seen in FIG. 10) placed on the same shoe as the ultrasonic transmitter 203, and the receivers (M-1,R) and (M+1,L) (also seen in FIG. 10) located on the neighboring shoes receive and store data to flash for y microseconds. Then, the logging tool stays idle for z microseconds for the induced ultrasound reverberations in the catcher sub to dissipate. In the next step, the next transmitter displaced azimuthally 22.5° from the first ultrasonic transmitter is activated and the procedure is repeated with the corresponding ultrasonic receivers. After all 16 ultrasonic transmitters are activated and the respective ultrasonic receivers received and stored the data, the cycle is repeated resulting in another circumference slice of the survey. However, activation of the new cycle can be made dependent on the movement of the logging tool along the well, to provide close to uniform coverage of the well and the same time do not overflow FLASH memory with the data while the drill string is in standstill motion, see FIG. 14 and section [0029] for description of characteristic movement of the drill string. The time x, y and z can be adjusted based on the exact geometry of the catcher sub, well, and the logging tool. As for an example implementation the values can be; x is 40 microseconds, y is 100 microseconds and z is 1 millisecond.

As discussed above, the USIT logging tool requires a wired connection to surface to operate. Thus, even if the USIT logging tooling were positioned inside a drill string, that would severely complicate the pulling and break out of drill pipe. Furthermore, such an operation would still require a wireline unit mobilized. USIT tools are also delicate downhole tools which is not necessarily easily modified to endure the harsh drilling environment, and lastly, performing casing measurements through the drill pipe with a conventional USIT logging tool would be quite difficult and provide poor images at best, due to the nature of having to measure through multiple layers of fluid and the drill pipe steel wall.

There are several methods for the casing integrity investigation such as USIT which require direct exposure of the tool to the downhole fluids, i.e., direct access to the well bore. Patents GB2399411A, U.S. Pat. Nos. 6,125,079A, 9,523,273B2, 6,018,496A, U.S. Ser. No. 10/138,727B2 describe wireline tools. Patent U.S. Pat. No. 10,145,237 describes the battery driven tool attached to the top of the bottom hole assembly which mechanically couples drill pipe and bottom hole assembly, and therefore, have direct access to the well bore. US 558,982,5 describes a drilling sub capable of receiving logging tool and comprising hydraulically activated window providing access to the well bore. U.S. Pat. No. 7,787,327B2 describes a tool which induces transversely polarized shear waves directly into the casing and seems to be less practical than tools described in other cited application. U.S. Ser. No. 10/138,727B2 allows measurement of plurality of casings and can be considered similar in principle to measurements of the casing through the drill pipe, however, it requires to use at least two different sound-based measurement modes.

The processing of raw data for the cased sections of the well can in one specific implementation consist of the following steps, for each circumference as illustrated in FIG. 13:

1) Read data packages from all ultrasonic receivers covering the complete circumference 1301.
2) Using recorded data from each ultrasonic receiver 204 calculate distance from each ultrasonic transducer to the inner surface 206 of the casing 200 along received acoustic beams, which typically corresponds to the first strong echo detected by matched filter in the time window corresponding to the expected arrival time of signals from the casing 1302.
3) Combine data from all ultrasonic receivers 204, to derive the eccentricity of the catcher sub 202 inside the casing 200. For example, for this purpose the points A1 and A2 in FIG. 8 (direction of eccentricity) can be identified by the fact that ultrasonic receivers (M,L) and (M,R) corresponding to each of the points A1 and A2 desirably will record near equal signal strength and arrival time of the first echo from the inner surface of the casing 200. The difference in arrival time of the echo from the inner surface of the casing 200 between point A1 and point A2 corresponds to the eccentricity. One more advanced method, not described here for the sake of brevity, allows accounting for the possible wear of the casing 200 and/or its shape not being circular. The data from previous analyzed circumferences can be used as initial guess for the eccentricity 1303.
4) Each receiver record desirably will be assigned to azimuthal angle span on the surface of the casing 200 based on the simulator data 1311 for the given eccentricity 1304.
5) The distance to the inner surface of the casing 200 for each azimuthal span desirably will be calculated by matching measured values and simulator data 1305.
6) Using the obtained amplitude of signal and distance to the inner wall of the casing 200, and data from previous circumferences to identify rock cuttings in the mud or other reasons for outlying results. Based on the obtained geometry of the inner casing surface, correct the eccentricity calculated in step 3 and correct the azimuthal span assigned to each data package. The eccentricity of the catcher sub 202 desirably will change relatively slowly during the drill string pull-out, therefore, the data from several previous circumferences can be used to calculate exact eccentricity 1306.
7) The distance to the outer casing 200 wall is calculated based on the simulator data 1311 with given eccentricity, azimuthal span, distance to the inner casing 200 wall and the difference between arrival time of the echo or echoes from the inner casing 200 wall and the outer casing 200 wall 1307. The absence of the echo from the outer casing 200 wall around the whole circumference desirably will indicate uncased portion of the well.

8) The casing 200 thickness is calculated using the distance to inner and outer surface for each azimuthal span and respective path of ultrasound waves 1308.

9) FIG. 10 shows that some of the data correspond to overlapping azimuthal spans.

Such data can be processed to refine azimuthal resolution 1309.

10) The ratio of the amplitude of the echo or echoes from the outer casing 200 surface to the measured amplitude of the echo or echoes from the inner casing 200 surface can be compared to the ratio of respective echoes in simulator data to estimate the acoustic impedance of the material behind the outer casing surface, and thus identify the material behind the casing, i.e., cement, cement with poor bond to the casing 200 or presence of fluid or trapped gas. Also, an absence of the echo from the outer surface of the catcher sub in combination of the low amplitude of the echo from the inner surface of the casing desirably will indicate a hole in the casing 1310.

The simulated data for each circumference slice with its eccentricity, the casing wear, well fluid 201 properties can either be calculated during processing or can be prepared in advance and used as look up tables. When the uncased portion of the well is detected, the processing is stopped at step 1306.

FIG. 11 shows how the dimensional data 1100 is oriented in a 3D space along the wellbore axis 1101 of the wellbore. The 3D model can in one embodiment be a point cloud model constructed by the inner diameter 1102, casing thickness 1103 which is the difference between the casing outer and inner diameters, azimuth angle 1104 and measured depth 1105 oriented around the wellbore axis 1101 by the use of cylindrical coordinates.

To build a 3D model of the casing wear, it is desirable to know orientation and position of the tool when each set of circumferential measurements is done. The axial location along the wellbore axis 1101, the depth of the logging tool in the well bore and the orientation of the logging tool 1700 is obtained by positioning system which in one embodiment is done by dead reckoning method using measurements from the Inertial Measurement Unit (IMU), or at least combination of 3 accelerometers and at least one gyro directed along the wellbore axis 1101, forming positioning system. Additionally, an inclination and azimuthal orientation of the well can be derived from the measured orientation of the tool while it was pulled out of the well. The positioning system, for example, can comprise of high temperature ADXL206 accelerometer and ADXRS645 gyro from Analog Devices, or more accurate IMU such as DMU11 from Silicon Sensing which is however has lower operational temperature range. The dead reckoning can be done in real-time downhole and the calculated change of position can be used to control activation of transducers, for example to reduce desirable data storage volume. It is also well known that a more precise determination of orientation and location is possible by the post processing of the all raw data recorded during dead reckoning in comparison with the use of the real-time algorithms. Another source of the positional data along the well can be a static pressure sensor, which can be either used instead of accelerometer responsible for the position along the well or be used to decrease drift of the calculated position.

It is known that the use of inertial sensors generally leads to accumulation of positional error due to corruption of the true motion characteristics by the sensor bias drift and random noise. However, the typical movement of the drill string in the current application (see FIG. 14) reduces the effect of sensor errors on the calculated position. Each stand typically holds 3 joints of drill pipe. The motion sequence will typically be hoisting out the drill string from standstill to a maximum velocity of about 3 ft/second, then deaccelerating to a standstill when the complete stand is out of hole and the drill string is locked to the rig floor. The traveling distance of one stand is typically 90 ft, where each joint of drill pipe is 30 ft. At each standstill, the rig crew desirably will break out the stand of pipe from the drill string, and the motion pattern desirably will be repeated. The break of one stand desirably will typically take more than 10 seconds, i.e., more than 20% of the time the drill pipe is in a standstill condition during the whole operation of the drill pipe pull out. The standstill condition desirably can be detected from the acceleration data by the use of at least one of the two criteria: 1) the total measured acceleration is different from the gravitational force by less than, for example, 0.02G; and 2) any movement even with constant velocity desirably will create interaction of the drill pipe with the casing and resulting vibrations, during the stand still, thus, during standstill variation of acceleration should be lower than during movement, and the spectral characteristic of the acceleration and angular rate during standstill state measured by inertial sensors desirably will be closer to the typical characteristic of random noise. These criteria can be for example refined in the post processing of the full record of the motion during survey. The recorded acceleration and angular velocity during standstill can be used to derive the bias of sensors. The fact that approximately 20% of the time the logging tool 1700 is in the standstill condition and such condition happens regularly should allow one to derive sensor bias with great accuracy. Additional, correction of the calculated position and the sensor noise can be done from the comparison of the total distance measured by dead reckoning and the total number of stops multiplied by the stand length. For example, the scaling of the total integrated distance by the known length of the well can be used. After compensating measurement for the bias, the gyro measurements desirably will be corrupted predominantly by the scale factor error and random noise and noise induced by the vibrations in the oil well. Thus, the total azimuthal angle error desirably will be approximately 1-10° depending on the vibrations in the oil well. And over a short distance of the well it desirably will be negligible (for example, less than 1 degree or less than ½ degree) and it desirably will be possible to identify character of the casing damage. In addition, the ultrasound measurements desirably will detect position of casing collars, and it can also be used to improve accuracy of positioning data.

As the stored data on the logging tool 1700 is downloaded to a Laptop/PC or Tablet, the borehole/casing data can be post-processed using software. A visual representation of the stored data including casing dimensions, bore hole shape and size can be superimposed on an image of the wellbore trajectory, which is constructed by the inclination, azimuth and measured depth (Z Position). The software further facilities automated identifications and calculations of the casing integrity. FIG. 15 shows a wellbore 1500 in a subsurface formation 1501 comprising a cased section of the well bore 1500 with the casing 200 which is secured with cement 1503 to the subsurface formation 1501. The wellbore may also include an open hole section 1504.

In one embodiment, the method of identifying the casing collars 1506 and correlating a position with measured depth 1105 is done by comparing the casing thickness 1103 data over a segment of casing 200 along the wellbore axis 1101 direction. When the casing thickness 1103 shifts from a mean casing thickness in accordance with API Specification to a larger casing thickness, for a given length along the casing 200 segment in the wellbore axis 1101 direction, which matches with the length associated with the casing collars 1506, a casing collar 1506 is identified and correlated to the measured depth 1105.

In one embodiment, the method of identifying the casing 200 segment and correlating a position with measured depth 1105 is done by measuring the distance between two identified casing collars 1506 according to section [0031][0029] and comparing this measured distance of casing 200 segment with the standard lengths of casing 200 in accordance with API Specification. Each segment can be tagged with a unique identification number, starting from rig floor.

In one aspect, a desirable method of identifying a key seat wear 1507 of the casing 200 where the casing thickness 1103 (FIG. 11) as a function of azimuth angle 1104 (FIG. 11) is irregular. The parameters for determining the key seat wear 1507 can in one embodiment be user defined. A non-limiting example is if the casing thickness 1103 varies >10% for <180° of the azimuth angle 1104 around the wellbore axis 1101, a key seat wear 1507 confirmation is made. Another non-limiting example is if casing thickness 1103 varies >5% for <than 20° of the azimuth angle 1104 around the wellbore axis 1101, a key seat wear 1507 confirmation is made.

In one aspect, a desirable method of identifying over-torqued casing collars 1509, is done when an identified casing collars 1506 is made according to section [0031] and where the inner diameter 1102 is smaller than the typical inner diameter of the casing 200 in accordance with API Specification. A non-limiting example is, if the inner diameter 1102 (FIG. 11) located at an identified casing collar 1506 is <5% comparing to the inner diameter 1102 of the casing 200 segment, an over-torqued casing collars 1509 is confirmed.

In one aspect, a desirable method of identifying open hole section 1504 of the well bore 1500 and correlating a position with measured depth 1105 is done by detecting no echoes from the casing outer surface 207 over the whole circumference for the given location along wellbore axis 1101 in the time window where the echoes from the casing outer surface 207 are expected to be detected.

In one aspect, a desirable method of identifying open hole wash-outs 1505 and correlating a position with measured depth 1105 is done by comparing inner diameter 1102 of an identified open hole section 1504 of the wellbore 1500 to the mean inner diameter 1102 of said section. A non-limiting example is, if the inner diameter 1102 of the identified open hole section 1504 is larger than >30%, an open hole wash-outs 1505 is confirmed.

In one aspect, a desirable method verifying the casing 200 integrity of the wellbore 1500 is done by calculating the expected burst pressure of individual casing 200 segments correlated to measured depth 1105, by using the Barlow equation for minimum internal yield pressure specified in API Bull. 5C3 "Formulas and calculations for casing, tubing, drill pipe, and line pipe properties".

$$P_B = 0.875\left[\frac{2Y_p t}{D}\right]$$

Where $P_B$ is the minimum burst pressure in psi, $Y_p$ is the input parameter for the minimum yield strength of the casing 200 segment in psi, t is the measured casing thickness 1103

D is the measured casing outside diameter

The minimum burst pressure of each casing 200 segment can be probed and visualized on the 3D model of the survey data in the Graphical User Interface on a PC or Tablet.

In another aspect, a desirable method verifying the casing 200 integrity of the wellbore 1500 is done by calculating the expected collapse pressure of individual casing 200 segments correlated to measured depth 1105, by using the numerical curve fit between plastic and elastic regimes. This curve fit desirably will give the transition collapse pressure of the casing 200 segment specified in API Bull. 5C3 "Formulas and calculations for casing, tubing, drill pipe, and line pipe properties".

$$P_T = Y_P\left[\frac{F}{D/t} - G\right]$$

Where $P_T$ is the transition collapse pressure in psi, $Y_p$ is the input parameter for the minimum yield strength of the casing 200 segment in psi, D is the measured casing outside diameter t is the measured casing thickness 1103

F and G are curve fit factors found in Table 7.5 in API Bull. 5C3 "Formulas and calculations for casing, tubing, drill pipe, and line pipe properties" FIGS. 16. F and G are selected based on the input parameter "Material grade" of the casing 200 segment.

The transition collapse pressure of each casing segment can be probed and visualized the 3D model of the survey data in the Graphical User Interface on a PC or Tablet.

FIG. 17 shows an external view of the logging tool 1700. The logging tool 1700 includes an external fishing profile 1701 with an flow inlet port 1702 for fluid circulation, a set of activation pins 1703, a hydraulic deployment system 1704, a hydraulic seal 1705, a set of extendable ultrasonic transducer shoes 1706, an electronics vessel 1707, a set of seals, such as wiper seals 1708, a landing shoulder 1709, the flow outlet ports 1710 for fluid circulation and the battery vessel 1711. The logging tool 1700 can be hung from the external fishing profile 1701 during deployment and retrieval using conventional external fishing tools. The hydraulic deployment system 1704 is a piston assembly in connection with the underside of the extendable ultrasonic transducer shoes 1706. When activated, the hydraulic deployment system 1704 desirably will transfer the hydraulic force load, via a wedge-shaped tubular assembly 2101 (FIG. 21) to radially push outwards the extendable ultrasonic transducer shoes 1706 towards the catcher sub 202 inside wall structure. A non-limiting example of the logging tool 1700 build material can be a corrosion resistant nickel alloy like Inconel Alloy 718 (Unified Numbering System N07718). A non-limiting example of suppliers for the hydraulic seal 1705 is the Swedish company TRELLEBORG, and the material grade can be HNBR or FKM depending on the fluid conditions of the well.

Figure 19:
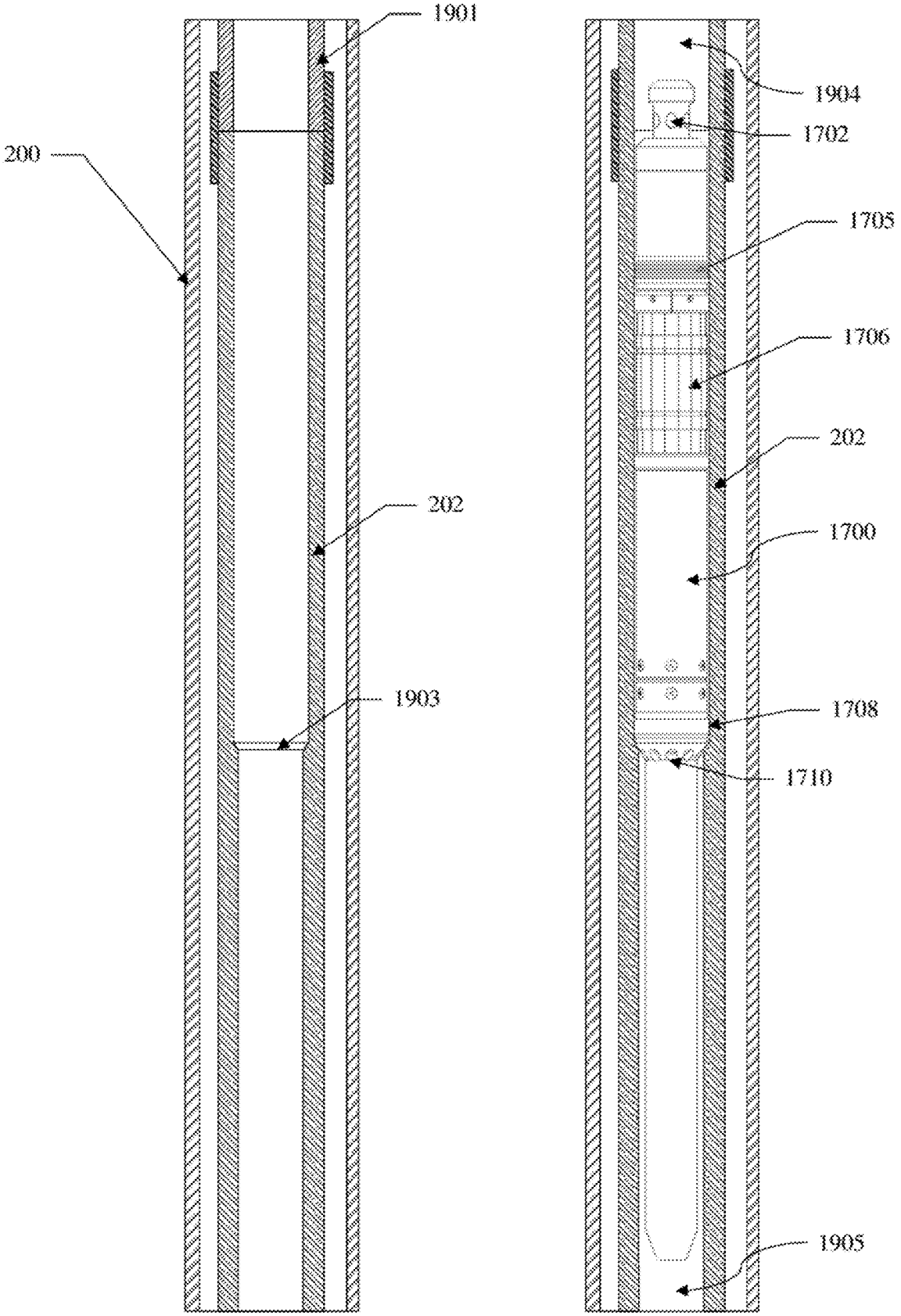

FIG. 18 shows a cross-sectional view of the logging tool 1700. The logging tool 1700 has a set of flow inlet ports 1702, which desirably will facilitate fluid pressure build up on the activation disc assembly 1801 when the logging tool 1700 has landed in the catcher sub 202 (FIG. 19). The logging tool 1700 desirably will effectively seal off the fluid circulation in the drill string with the hydraulic seal 1705 sealing against the inside wall structure of the catcher sub 202. The activation disc assembly 1801 desirably will burst open when a predetermined pressure differential is achieved, resulting in a pressure drop on the fluid circulation system. The pressure build-up and drop can be detected at surface by the circulation pump pressure and give confirmation of the logging tool position and status, further described above. The hardware electronics 1802 which is further described above, is encapsulated in the electronics vessel 1707 which facilitates the ultrasonic transducer array control and signal processing units, power management and local memory storage. The flow outlet ports 1710 enables fluid circulation thru the logging tool 1700 when the activation disc assembly 1801 is burst open. The pressure bulkhead assembly 1803 enables a pressure sealing of the battery cells 1804 in the battery vessel 1711 while providing an electrical power connection between the electronics vessel 1707 and the battery vessel 1711. A non-limiting example of suppliers for such pressure bulkhead lids is the US based company "KEMLON". The battery cells 1804 can be connected in parallel and series to achieve the desired capacity and voltages and desirably will typically be made of high energy density, high temperature primary Lithium batteries or rechargeable Lithium batteries. A non-limiting example high temperature primary battery chemistry is Lithium Thionyl Chloride cells and a potential supplier is the German based company "TADIRAN".

FIG. 19A show the wellbore with the casing 200 and the drill pipe 1901 connected to the catcher sub 202. The catcher sub 202 desirably will catch and retain the logging tool 1700 with the NO-GO shoulder 1903. The inner diameter of the NO-GO shoulder 1903 is smaller than the outer diameter landing shoulder 1709 (FIG. 17) of the logging tool 1700 ensuring a correct placement of the logging tool 1700 inside the catcher sub 202. The catcher sub 202 and drill pipe 1901 size, weight class and material grade depend on the drilling location, depth and service environment. A non-limiting example of drill pipe 1901 can be 4" OD pipe 14# ppf. (Pounds per feet) and S-135 grade in accordance with API (American Petroleum Institute) Specification. The casing 200 size, weight class and material grade depend on the location, depth and service environment of the well. A non-limiting example of casing 200 can be 7" OD casing 32# ppf. (Pounds per feet) and L-80 Grade in accordance with API Specification.

FIG. 19B shows the logging tool 1700 landed inside the catcher sub 202 prior to deployment of the extendable ultrasonic transducer shoes 1706. The wiper seals 108 desirably will collapse to the smaller inner diameter, and also wipe clean the inside wall structure of the catcher sub 202 when the logging tool 1700 enters, thus ensuring a debris free contact surface for the extendable ultrasonic transducer shoes 1706. When the logging tool 1700 is landed inside the catcher sub 202, the fluid flow desirably will be prevented to circulate thru this portion of the drill string, whereas the hydraulic seal 1705 and the activation disc assembly 1801 (shown in FIG. 18) provide a pressure seal barrier between the upstream and downstream portion of the logging tool 1700. This pressure seal desirably will result in a pressure buildup which is detectable at the surface on the circulation pump pressure gauge. This information desirably will be used to confirm the "landed" state of the logging tool 1700 in the catcher sub 202.

FIG. 20 shows the circulation pressure trace 2000 on the circulation pump pressure gauge after the untethered dropping and during the deployment of the logging tool 1700 in the drill string. When the logging tool 1700 lands and seals in the catcher sub 202 (shown in FIG. 19B) a pressure buildup 2001 desirably will occur due to the restriction of the flow area. When this pressure buildup 2001 is detected on the pressure gauge at surface, the deployment procedure states that the logging tool 1700 is landed in the catcher sub 202. The deployment procedure further instructs the rig crew to increase the pump throttle to increase the circulation pressure, resulting in a pressure increase 402 on the upstream portion 1904 of the logging tool 1700 (FIG. 19B). The pressure increase 2002 on the upstream portion 1904 of the logging tool 1700 acts on the hydraulic deployment system 1704 (FIG. 21) which is secured with a set of activation pins 1703 until the pressure force exerted on the hydraulic deployment system 1704 exceed the tensile strength of the activation pins 1703, releasing the hydraulic deployment system 1704. The hydraulic deployment system 1704 move in the pressure force direction and push the extendable ultrasonic transducer shoes 1706 outwards radially towards the inside wall structure of the catcher sub 202 via a wedge-shaped tubular assembly 2101. The hydraulic deployment system 1704 uses the pressure increase 2002 to achieve the designated contact pressure on the contact surface 2102 between the extendable ultrasonic transducer shoes 1706 and the inside wall structure of the catcher sub 202 which is further described above. When the designated contact pressure is achieved, the activation disc assembly 1801*a* desirably will burst open 201*b*, releasing the pressure increase 2002 on the upstream portion 1904 of the logging tool 1700 via the flow inlet ports 1702 and flow outlet ports 1710 (FIG. 19) to the downstream portion 1905, resulting in a pressure drop 2003 on the circulation pump pressure gauge at the surface. The deployment procedure desirably will further state that this pressure drop 2003 is the confirmation of the successful deployment of the logging tool 1700 in the catcher sub 202.

The wedge-shaped tubular on the hydraulic deployment system 1704 (FIG. 21) has mating surfaces 2101 which define mirrored wedge angles corresponding to mating surfaces 2203 on the backbone wedge 2202 (FIG. 23), which is the corresponding contact surface on the extendable ultrasonic transducer shoes 1706 further described above. In one embodiment, the wedge angle is to be lower than the frictional angle between the two contacting bodies, resulting in a backlash free friction lock in order to secure and maintain the contact pressure and anchoring force of the logging tool 1700, after the pressure drop 2003 (FIG. 20) occur. In order to achieve a friction lock between a wedged contact surface, the following relation must be true:

$$\alpha<\theta$$

Whereas $\alpha$ is the wedge angle and $\theta$ is the frictional angle between the two contacting bodies.

The frictional angle can be expressed as:

$$\tan\theta = \frac{R}{N} = \mu$$

Whereas R is the friction force component in the contacting plane between the two bodies, N is the contacting force normal to the contacting plane and $\mu$ is the friction coefficient between the contacting two bodies. As an example calculation, for a lubricated steel on steel surface contact a friction coefficient of 0.1 is used, thus the frictional angle desirably will be 5.7° degrees. In order to ensure a friction lock between the contacting two bodies a wedge angle lower than the friction angle should desirably be used, and in the furtherance of this example, $\alpha=4°$ degrees is used.

The transfer coefficient of the acoustic waves through the layer between ultrasonic transducer and the catcher sub 202 can be illustrated using the case with the normal incidence of the wave to the interfaces which is represented by the following equation:

$$|T| = \frac{1}{\sqrt{0.25\left(\varsigma - \frac{1}{\varsigma}\right)^2 \sin^2(kd) + 1}}$$

where $\zeta$ is the ratio of the acoustic impedance of the layer between ultrasonic transducer and the catcher sub to the acoustic impedances of the catcher sub 202 and the ultrasonic transducer, it can be assumed that the acoustic impedance of the catcher sub 202 and the ultrasonic transducer are equal without great loss of generality. The layer between ultrasonic transducer and the catcher sub 202 can be coupling layer which is described further or the well fluid. k and $\zeta$ are the wavenumber and thickness of the layer between acoustic transducer and the inner surface of the catcher sub 202. For example, the outer diameter of the USIT tool designed to survey minimum 4.5" casing creates layer between the tool outer diameter and the casing of approximately 10 mm thickness. In typical application the transfer coefficient, |T|, of the acoustic waves with the frequency range between 0.1 MHz and 1.5 MHz will vary from 7% to 100% if absorption inside the layer is neglect depending on $\zeta$ and k which is dependent on the wave frequency. However, such large variation of the transfer coefficient with frequency is unsuitable to transfer frequency sweep. Presumably, if the layer between the ultrasonic transducer and the catcher sub 202 is having acoustic impedance of 1.5 MRayl, the distance between the ultrasonic transducer and the catcher sub 202 should be less than 4 mm to be able to transfer frequency sweep with the band width greater than 0.1 MHz. However, it is hard to facilitate exactly required distance in the well fluid. A simpler solution is to push transducers against the surface of the catcher sub 202 to achieve as thin layer of the well fluid between the ultrasonic transducers and the catcher sub 202 as possible, ideally aiming to avoid to have any well fluid in between the ultrasonic transducer and the catcher sub 202. To facilitate the transfer coefficient greater than 7% for the frequencies above 0.1 MHz and the bandwidth of greater than 0.1 MHz, the thickness of the layer between ultrasonic transducer and the catcher sub 202 has to be less than 0.8 mm.

FIG. 22 and FIG. 23 show a more detailed view of the transducer arrangement inside the extendable ultrasonic transducer shoes 1706 in contact with the catcher sub 202. In case, the inner surface of the catcher sub 202, facilitating the contact surface 2102, will be uneven or the catcher sub geometry may be deformed during well operations. To overcome this challenge, at least one of two solutions is desirably implemented to facilitate a good acoustic contact between the extendable ultrasonic transducer shoes 1706 and the catcher sub 202.

To overcome the rough contact surface inside the catcher sub 202, the contact pads 405 on the extendable ultrasonic transducer shoes 1706 are desirably deformed to match the shape of the inner surface of the catcher sub 202 upon contact. Relatively low force can be applied to achieve the greater ultrasound energy transfer compared to the case when there is a well fluid 201 in between the catcher sub 202 and the ultrasonic transducer. The ultrasound energy transfer desirably will increase with the increase of pressure and when the contact pressure on the contact surface 2102 approaches approximately ⅕ of the yield strength of the material of the contact pads, the transfer coefficient will be greater than 10% of the value predicted for the ideal solid-solid interface. The piezoelectric element 404 generally cannot be used directly as typically piezoceramic material has very high yield strength and low ductility and the necessary contact pressure may damage the piezoceramics or the contact interface between the transducer and catcher sub 202. To overcome this, the surface of the transducers desirably comprises contact pads 405 with a soft coupling material with matching acoustic impedances of materials on both sides. Any material with acoustic impedance higher than the acoustic impedance of the well fluid 201, which is approximately 1.5 MRayl, desirably will provide higher transfer coefficient than if there would be the well fluid 201 in between transducer and the catchers sub.

For the ultrasonic survey it is beneficial to have as high a transfer coefficient |T| as possible. A transfer coefficient higher than 20% can be achieved by having contact pads 405 with the acoustic impedance higher than 4.5 MRayl and higher than 50% with the contact pads 405 with acoustic impedance higher than 12 MRayl. Non-limiting examples of such materials, can be annealed copper, tin or lead, which have compressional acoustic impedances of 40, 24 and 19 MRayl, respectively. Theoretically, the transfer coefficient |T| through such coupling material for the compressional wave and normal incidence can be higher than 99% for copper, 83% for tin, 72% for lead if sufficient contact pressure is provided, and such transfer coefficients are much greater than the transfer coefficient through the well fluid 201 which was shown to be approximately 7% for certain frequencies if the distance between the ultrasonic transducer and the catcher sub 202 Is greater than 0.8 mm.

Sufficient contact pressure can in one aspect be designated by the plastic deformation of the contact pads 405 on the extendable ultrasonic transducer shoes 1706. Thus lower force can be used if the material with low yield strength is used for contact pads 405. The necessary contact force to achieve plastic deformation of the contact pads 405 will generally be determined by the yield strength of the contact pads 405 material and the contact surface 2102 area. The contact force is transferred from the hydraulic deployment system 1704 via the wedge-shaped tubular assembly 2101 to the backbone wedge 2202, which utilize the pressure increase 2002 (seen in FIG. 20), thus the burst pressure of the activation disc assembly 1801 desirably will control the contact force and ultimately the contact pressure on the contact surface 2102. The burst pressure of the activation disc assembly 1801 can be calculated by the following expression:

$$P_{Burst} = \tan\alpha \cdot \sigma_{yield} \cdot \frac{A_{contact} \cdot N_{shoes}}{A_{piston}}$$

Whereas $\alpha$ is the wedge angle on the wedge-shaped tubular assembly 2101 and similarly on the backbone wedge 2202 (FIG. 22 and FIG. 23), $\sigma_{yield}$ is the stress in the contact pads 405 material, $A_{piston}$ is the area of the piston in the hydraulic deployment system 1704 (FIG. 21) and $A_{contact}$ is the contact surface 2102 and $N_{shoes}$ is the number of extendable ultrasonic transducer shoes 1706. As a furtherance of the example calculation started in section and when selecting contact pads 405 material to be soft copper with yield strength of 5 ksi, the number of extendable ultrasonic transducer shoes 1706 to be 16 and the ratio of area between contact surface 2102 and piston area to be ⅓, the burst pressure of the activation disc assembly 1801 can be calculated to be:

$$P_{Burst} = \tan 4^\circ \cdot 5\ \text{Ksi} \cdot \frac{16}{3} = 1865\ \text{psi}$$

The above example calculation is much simplified when compared to real life scenarios, like friction loss, misalignments etc., thus the correct burst pressure of the activation disc assembly should desirably be validated through testing.

To overcome the uneven or deformed contact surface 2102 inside the catcher sub 202, each extendable ultrasonic transducer shoes 1706 desirably will be able to adjust its radial position independently. In one aspect, this is desirably achieved with the use of a flexible backbone wedge 2202 (FIG. 22 and FIG. 23), which desirably will flex with a stiffness and deflection large enough to overcome the uneven/deformed internal geometry of the catcher sub 202 while still delivering the necessary contact force to obtain deformation of the contact pads 405. In another embodiment, each extendable ultrasonic transducer shoe 1706 is hydraulically deployed by individual pistons, ensuring similar contact force to obtain uniform deformation of the contact pads 405 on all extendable ultrasonic transducer shoes 1706. This solution is more challenging to implement as it desirably will require multiple sealings and a hydraulic pressure distribution system. The hydraulic force can be obtained similarly to the hydraulic deployment system 1704 and be controlled by the burst pressure of the activation disc assembly 1801. In order to retain the extendable ultrasonic transducer shoes 1706 in the deployed state a check valve system can be implemented to maintain the contact force.

The extendable ultrasonic transducer shoes 1706 desirably facilitate movement in radial direction outwards from the logging tool 1700 to contact with the internal geometry of the catcher sub 202, in order to shift from undeployed 1706*a* to deployed state 1706*b*. The travel distance can be small, however there desirably will be a flexibility or joint to facilitate radial displacement. Similarly, the extendable ultrasonic transducer shoes 1706 also should be retained on the logging tool 1700 and facilitate an electrical connection from the piezoelectric elements 404 and into the electronics vessel (FIG. 18). In a preferred embodiment, the piezoelectric elements 404 are molded inside in a flexible encapsulation 2204 (FIG. 23). A non-limiting example of a backbone wedge 2202 material is a nickel alloy Inconel Alloy 718 (Unified Numbering System N06625). A non-limiting example for the moldable flexible encapsulation 2204 material can be a polyurethane based resin like Scotchcast™ 2130 or a liquid HNBR (Hydrogenated nitrile butadiene rubber). A non-limiting example supplier of piezoceramics is the French company IMASONIC.

During drilling operation, the surface of the catcher sub 202 will be damaged by cuttings and wear complicating ultrasonic measurements. There exist several ways to protect surface of the catcher sub 202 through which ultrasound waves are sent: 1) produce the catcher sub from harder alloy than grade S-135; 2) cover the outer surface of the catcher sub with a harder material, for example, harder steel, chrome or tungsten-carbide; or apply surface hardening methods such as carburizing or nitriding or other 3) modify geometry of the catcher sub or geometry of the dart such that ultrasonic transmitters 203 and ultrasonic receivers 204 are placed along the catcher sub against recessed parts on the outer surface of the catcher sub; 4) run calibration measurements with landed logging tool 1700 inside the catcher sub 202 before or after the well survey which is further used as the reference data to be subtracted from each measurement for each receiver such as illustrated in FIG. 5B and FIG. 5C. The reference data for the ultrasonic receiver 204 can be also obtained from the data analysis, selecting measurements with high eccentricity in which the ultrasonic receiver 204 receives negligible response on the echoes from the casing inner surface.

Additional ultrasonic receivers spaced along the axis of the logging tool can be used for redundancy purpose and to confirm measurements done by main row of ultrasonic receivers 204. They can be as well used for measurements of ultrasound velocity in the well fluid 201 to increase the measurement accuracy of the casing inner diameter. The sound velocity in the well fluid 201 can also be derived from the measured casing inner diameter for the circumferential slices for which no or little damage was detected.

The processing electronics should desirably consist of components designed for high temperature environment. The main components desirable for data acquisition are shown in FIG. 24. To facilitate signal sending by several transducers and data receival by several receivers simultaneously, it may be desirable to increase number of digital signal processors (DSP) or replace DSP with field-programmable gate array (FPGA). An implementation with higher azimuthal resolution or introduction of the second row of receivers desirably will require to increase the number of ultrasonic transmitters 203 and ultrasonic receivers 204, and therefore, it will be desirable to proportionally increase the number of electronics components, however, conceptually the same electronics scheme can be used as in FIG. 24.

There is further disclosed a method for measuring the thickness of casing in a wellbore comprising:

positioning a drill string in a wellbore;

positioning an untethered logging tool in the drill string;

pumping fluid into the drill string so that the fluid pushes the logging tool toward a distal end of the drill string so that the logging tool moves in an untethered manner;

receiving the logging tool in a catcher positioned within the drill string;

positioning a plurality ultrasonic transducers with the average distance between the outer surface of transducers and an interior surface of the catcher sub less than 0.8 mm;

moving the drill string and the logging tool toward a mouth of the borehole;

while moving the drillstring and the logging tool toward a mouth of the borehole, transmitting acoustic waves through the catcher sub toward the wellbore casing with the logging tool and receiving acoustic waves after the acoustic waves interact with the wellbore casing and reflect back to the logging tool through the catcher; and while moving the drill string and the logging tool toward the mouth of the borehole, processing and storing data.

The method may include, wherein the positioning of the untethered logging tool in the drill string occurs after at least a portion of the drill string is positioned in a wellbore.

The method may further comprise (1) positioning a plurality of ultrasonic transducers sufficiently close to the inner surface of the catcher sub to achieve acoustic transmission between the surface of the catcher sub and (2) wherein the transmitting acoustic waves through the catcher sub toward the wellbore casing and the receiving of the acoustic waves is performed with the plurality of transducers.

The method may further comprise pressing a plurality of ultrasonic transducers against the inner surface of the catcher sub, wherein the transmitting acoustic waves through the catcher sub toward the wellbore casing and the receiving of the acoustic waves is performed with the plurality of transducers.

The method may include wherein the plurality of ultrasonic transducers are contacting the interior surface of the catcher sub during the withdrawal of the drill string from the wellbore.

The method may include, wherein said pressing step further comprises pressing a plurality of ultrasonic transducers against the inner surface of the catcher sub so that at least one of the plurality of ultrasonic transducers is in contact with the inner surface of the catcher sub in each quadrant of the catcher sub in a cross-section perpendicular to a longitudinal axis of the catcher.

A method may include wherein the pressing step further comprises pressing a layer of coupling material which yield strength is lower than the yield strength of the catcher sub over a surface of each of the plurality of transducers pressed against catcher sub.

A method may include wherein the pressing step further comprises pressing a covering material of acoustic transducer with at least compressional or at least shear acoustic impedance greater than at least 4% of the respective impedances of catcher sub and a yield strength of a covering material of acoustic transducer is lower than the yield strength of catcher sub.

The method may further comprise transferring data from a downhole processor to a second processor.

The method may further comprise transferring data from the downhole processor to the second processor when the downhole processor is within one hundred feet of the mouth of the wellbore and/or is positioned outside of the wellbore.

The method may included where the ultrasound transmitter and ultrasound receiver are separated forming a pitch-catch configuration and the acoustic waves are transmitted from an ultrasonic transmitter at a first location and are received by an ultrasonic receiver at a second location spaced from the first location.

The method may include wherein the transducers are at a non-perpendicular angle with respect to the inner surface of the catcher sub and the acoustic waves are transmitted by the transducer transmitter from a first location at a non-perpendicular angle with respect to the longitudinal axis of the casing and are received at a second location spaced from the first location at a non-perpendicular angle with respect to the longitudinal axis of the casing by the ultrasound receiver.

The method may include wherein the plurality of transducers comprise a piezo element which is positioned at an angle with respect to the longitudinal axis of the casing and the acoustic waves are transmitted by the ultrasound transmitter from a first location at a non-perpendicular angle with respect to the longitudinal axis of the casing and are received at a second location spaced from the first location at a non-perpendicular angle with respect to the longitudinal axis of the casing by the ultrasound receiver.

The method may further comprise maximizing a magnitude of an echo of the acoustic wave off the outer surface of the casing by at least one of (1) transmitting the compressional acoustic waves from the ultrasonic transmitter into the catcher sub at an angle of less than 40 degrees with respect to the longitudinal axis of the casing and (2) transmitting the shear acoustic waves into the catcher sub at an angle of 33 to 87 degrees with respect to the longitudinal axis of the casing The method may further comprise receiving echoes from the acoustic waves being transmitted from the ultrasonic transmitters at a plurality of locations with ultrasonic receivers azimuthally spaced apart and longitudinally spaced apart from the ultrasonic transmitters.

The method may further comprise deflecting and/or absorbing the acoustic waves from the catcher sub by deflecting/absorbing material being a part of the logging tool or being a part of the catcher sub.

The method may include wherein said transmitting step comprises sending a wide band frequency signal which comprises at least one of frequency sweep and short pulse.

The method may include wherein the transmitting comprises transmitting with a bandwidth greater than 0.1 megahertz.

The method may include, wherein the transmissions contains a frequency greater than 0.05 megahertz and less than 1.5 megahertz.

The method may include, wherein the arrival time of reflected acoustic waves from the inner surface of the casing is measured with the arrival time of reflected acoustic waves from the outer surface of the casing to determine the thickness of the casing.

The method may further comprise substracting reflected acoustic echoes from different interfaces using expected replica of the echo and the time.

The method may include wherein the filtering of peaks in the filter output is determined by the frequency sweeps.

The method may further comprise recording logging and positional data in a memory of the logging tool as the drill string is moved toward the mouth of the wellbore.

The method may include wherein after a pre-selected number of transmissions, the ultrasonic transmitters do not generate ultrasonic waves until the tool senses that the logging tool has moved along the wellbore.

The method may further comprise using recorded data from each of the plurality of ultrasonic receivers to calculate the distance from each of the plurality of ultrasonic receivers to the inner surface of the casing.

The method may further comprise deriving an eccentricity of the catcher sub inside the casing.

The method may further comprise assigning an azimuthal angle span on the surface of the casing based on matching measured values to (1) look up tables or (2) simulator data.

The method may further comprise calculating the distance to the outer casing wall based on at least two of the following: (1) a look up table, (2) an eccentricity of the catcher sub within the casing, (3) the azimuthal span and (4) the difference between the arrival time of at least one echo from the inner casing surface and the outer casing surface.

The method may further comprise creating a visual representation of the casing wear after transferring the data from the downhole processor to the second processor.

Another aspect of the disclosure is apparatus for measuring the thickness of casing in a wellbore including: an untethered logging tool; a catcher configured to be positioned within a drill string; wherein when the logging tool is positioned within the catcher a plurality ultrasonic transducers are positioned with respect to an interior surface of the catcher such that the average distance between the outer surface of transducers and an interior surface of the catcher sub less than 0.8 mm; the logging tool including a transmitter configured to transmit acoustic waves through the catcher sub and a receiver configured to detect acoustic waves after the acoustic waves interact with the wellbore casing and reflect back to the logging tool through the catcher; and a data processor for storing data regarding the acoustic waves.

The apparatus may include a drill string providing fluid communication with the interior of the catcher.

The plurality of ultrasonic transducers may be sufficiently close to the inner surface of the catcher sub when the logging tool is positioned in the catcher to achieve acoustic transmission between the surface of the catcher sub and the inner surface of the catcher sub.

The plurality of ultrasonic transducers may be positioned against the inner surface of the catcher sub when the logging tool is positioned in the catcher.

The plurality of ultrasonic transducers may be positioned against the inner surface of the catcher sub in each quadrant of the catcher sub in a cross-section perpendicular to a longitudinal axis of the catcher when the logging tool is positioned in the catcher.

The apparatus may include layer of coupling material coating at least a portion of one of the plurality of ultrasonic transducers which has a yield strength lower than a yield strength of the catcher sub.

The layer of coupling material may have one of at least compressional or shear acoustic impedance greater than at least 4% of the respective impedance of catcher sub and the yield strength of the catcher.

The plurality of transducers may include an ultrasound transmitter and ultrasound receiver separated such that acoustic waves are transmitted from the ultrasonic transmitter at a first location and are received by an ultrasonic receiver at a second location spaced from the first location.

The plurality of transducers may be at a non-perpendicular angle with respect to the inner surface of the catcher sub.

At least the ultrasonic transmitter may be positioned with respect to the catcher sub (1) at an angle of less than 40 degrees with respect to a longitudinal axis of the casing and (2) such that the shear acoustic waves as transmitted at an angle of 33 to 87 degrees with respect to the longitudinal axis of the casing.

The plurality ultrasonic transducers may include a plurality of ultrasound receivers positioned to receive waves at a plurality of locations azimuthally spaced apart and longitudinally spaced apart from a plurality of ultrasonic transmitters.

At least one of the logging tool and the catcher may include deflecting/absorbing material.

The plurality of transmitters may be configured to send a wide band frequency signal which comprises at least one of frequency sweep and short pulse.

The plurality of transmitters may be configured to transmit with a bandwidth greater than 0.1 megahertz.

The plurality of transmitters may be configured to transmit with a frequency greater than 0.05 megahertz and less than 1.5 megahertz.

The apparatus may include at least one accelerometer and at least one gyroscope.

The apparatus may include a memory within the logging tool.

The memory of the apparatus may store at least one or more of (1) look up tables or (2) simulator data.

The apparatus may include a display configured to illustrate a visual representation of the casing wear.

The apparatus may include an accelerometer for determining the length of time the drill string is stopped.

Certain Terminology

Terms of orientation used herein, such as "top," "bottom," "proximal," "distal," "longitudinal," "lateral," and "end," are used in the context of the illustrated example. However, the present disclosure should not be limited to the illustrated orientation. Indeed, other orientations are possible and are within the scope of this disclosure. Terms relating to circular shapes as used herein, such as diameter or radius, should be understood not to require perfect circular structures, but rather should be applied to any suitable structure with a cross-sectional region that can be measured from side-to-side. Terms relating to shapes generally, such as "circular," "cylindrical," "semi-circular," or "semi-cylindrical" or any related or similar terms, are not required to conform strictly to the mathematical definitions of circles or cylinders or other structures, but can encompass structures that are reasonably close approximations.

Conditional language, such as "can," "could," "might," or "may," unless specifically stated otherwise, or otherwise understood within the context as used, is generally intended to convey that certain examples include or do not include, certain features, elements, and/or steps. Thus, such conditional language is not generally intended to imply that features, elements, and/or steps are in any way required for one or more examples.

Conjunctive language, such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain examples require the presence of at least one of X, at least one of Y, and at least one of Z.

The terms "approximately," "about," and "substantially" as used herein represent an amount close to the stated amount that still performs a desired function or achieves a desired result. For example, in some examples, as the context may dictate, the terms "approximately," "about," and "substantially," may refer to an amount that is within less than or equal to 10% of the stated amount. The term "generally" as used herein represents a value, amount, or characteristic that predominantly includes or tends toward a particular value, amount, or characteristic. As an example, in certain examples, as the context may dictate, the term "generally parallel" can refer to something that departs from exactly parallel by less than or equal to 20 degrees. All ranges are inclusive of endpoint Several illustrative examples of valves have been disclosed. Although this disclosure has been described in terms of certain illustrative examples and uses, other examples and other uses, including examples and uses which do not provide all of the features and advantages set forth herein, are also within the scope of this disclosure. Components, elements, features, acts, or steps can be arranged or performed differently than described and components, elements, features, acts, or steps can be combined, merged, added, or left out in various examples. All possible combinations and subcombinations of elements and components described herein are intended to be included in this disclosure. No single feature or group of features is necessary or indispensable.

Certain features that are described in this disclosure in the context of separate implementations can also be implemented in combination in a single implementation. Conversely, various features that are described in the context of a single implementation also can be implemented in multiple implementations separately or in any suitable subcombination. Moreover, although features may be described above as acting in certain combinations, one or more features from a claimed combination can in some cases be excised from the combination, and the combination may be claimed as a subcombination or variation of a subcombination.

Any portion of any of the steps, processes, structures, and/or devices disclosed or illustrated in one example in this disclosure can be combined or used with (or instead of) any other portion of any of the steps, processes, structures, and/or devices disclosed or illustrated in a different example or flowchart. The examples described herein are not intended to be discrete and separate from each other. Combinations, variations, and some implementations of the disclosed features are within the scope of this disclosure.

While operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Additionally, the operations may be rearranged or reordered in some implementations. Also, the separation of various components in the implementations described above should not be understood as requiring such separation in all implementations, and it should be understood that the described components and systems can generally be integrated together in a single product or packaged into multiple products. Additionally, some implementations are within the scope of this disclosure.

Further, while illustrative examples have been described, any examples having equivalent elements, modifications, omissions, and/or combinations are also within the scope of this disclosure. Moreover, although certain aspects, advantages, and novel features are described herein, not necessarily all such advantages may be achieved in accordance with any particular example. For example, some examples within the scope of this disclosure achieve one advantage, or a group of advantages, as taught herein without necessarily achieving other advantages taught or suggested herein. Further, some examples may achieve different advantages than those taught or suggested herein.

Some examples have been described in connection with the accompanying drawings. The figures are drawn and/or shown to scale, but such scale should not be limiting, since dimensions and proportions other than what are shown are contemplated and are within the scope of the disclosed invention. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various examples can be used in all other examples set forth herein. Additionally, any methods described herein may be practiced using any device suitable for performing the recited steps.

For purposes of summarizing the disclosure, certain aspects, advantages and features of the inventions have been described herein. Not all, or any such advantages are necessarily achieved in accordance with any particular example of the inventions disclosed herein. No aspects of this disclosure are essential or indispensable. In many examples, the devices, systems, and methods may be configured differently than illustrated in the figures or description herein. For example, various functionalities provided by the illustrated modules can be combined, rearranged, added, or deleted. In some implementations, additional or different processors or modules may perform some or all of the functionalities described with reference to the examples described and illustrated in the figures. Many implementation variations are possible. Any of the features, structures, steps, or processes disclosed in this specification can be included in any example.

In summary, various examples of logging apparatus and related methods have been disclosed. This disclosure extends beyond the specifically disclosed examples to other alternative examples and/or other uses of the examples, as well as to certain modifications and equivalents thereof. Moreover, this disclosure expressly contemplates that various features and aspects of the disclosed examples can be combined with, or substituted for, one another. Accordingly, the scope of this disclosure should not be limited by the particular disclosed examples described above, but should be determined only by a fair reading of the claims.

What is claimed is:

1. A method for measuring a thickness of casing in a wellbore and/or analyzing an inner surface of a cased or non-cased wellbore, comprising:

positioning a drill string in a wellbore;

positioning an untethered logging tool in the drill string;

pumping fluid into the drill string so that the fluid pushes the logging tool toward a remote end of the drill string so that the logging tool moves in an untethered manner;

receiving the logging tool in a catcher sub positioned within the drill string;

positioning a plurality of ultrasonic transducers with the average distance between an outer surface of the plurality of ultrasonic transducers and an interior surface of the catcher sub being less than 0.8 mm;

moving the drill string and the logging tool toward a mouth of the wellbore;

while moving the drill string and the logging tool toward a mouth of the wellbore, transmitting acoustic waves through the catcher sub toward the wellbore casing with the logging tool and receiving acoustic waves after the acoustic waves interact with the wellbore casing and reflect back to the logging tool through the catcher;

while moving the drill string and the logging tool toward the mouth of the wellbore, processing and storing data; and receiving echoes from the acoustic waves being transmitted from a plurality of ultrasonic transmitters at a plurality of locations with a plurality of ultrasonic receivers azimuthally spaced apart and longitudinally spaced apart from the plurality of ultrasonic transmitters;

wherein an arrival time of the reflected acoustic waves from an inner surface of the casing is measured with an arrival time of the reflected acoustic waves from the outer surface of the casing to determine the thickness of the casing.

2. The method of claim 1, wherein the positioning of the untethered logging tool in the drill string occurs after at least a portion of the drill string is positioned in a wellbore.

3. The method of claim 1, further comprising deriving an eccentricity of the catcher sub inside the casing.

4. The method of claim 1, further comprising pressing a plurality of ultrasonic transducers against the inner surface of the catcher sub, wherein the transmitting acoustic waves through the catcher sub toward the wellbore casing and the receiving of the acoustic waves is performed with the plurality of ultrasonic transducers.

5. The method of claim 4, wherein the plurality of ultrasonic transducers are contacting the interior surface of the catcher sub during withdrawal of the drill string from the wellbore.

6. The method of claim 4, wherein the pressing step further comprises pressing a plurality of ultrasonic transducers against the inner surface of the catcher sub so that at least one of the plurality of ultrasonic transducers is in contact with the inner surface of the catcher sub in each quadrant of the catcher sub in a cross-section perpendicular to a longitudinal axis of the catcher sub.

7. The method of claim 1, further comprising recording in a memory of the logging tool as the drill string is moved toward the mouth of the wellbore at least one of (1) logging and positional data and (2) acceleration and angular rate data.

8. The method of claim 7, further comprising creating a visual representation of casing wear based on the at least one of (1) logging and positional data and/or (2) acceleration and angular rate data after transferring the data from a downhole processor to a second processor positioned outside of the wellbore.

9. The method of claim 1, further comprising transferring data from a downhole processor to a second processor.

10. The method of claim 9, further comprising transferring data from the downhole processor to the second processor when the downhole processor is within one hundred feet of the mouth of the wellbore and/or is positioned outside of the wellbore.

11. The method of claim 1, wherein said transmitting acoustic waves through the catcher sub toward the wellbore casing comprises sending a wide band frequency signal which comprises at least one of frequency sweep and short pulse.

12. The method of claim 11, wherein the transmitting acoustic waves through the catcher sub toward the wellbore casing comprises transmitting with a bandwidth greater than 0.1 megahertz.

13. The method of claim 12, wherein the transmitted acoustic waves contain a frequency greater than 0.05 megahertz and less than 1.5 megahertz.

14. The method of claim 1, wherein the plurality of ultrasonic transducers include the plurality of ultrasonic transmitters and the plurality of ultrasonic receivers; and further comprising;

(1) positioning the plurality of ultrasonic transducers sufficiently close to the inner surface of the catcher sub to achieve acoustic transmission between the surface of the catcher sub and (2) wherein the transmitting acoustic waves through the catcher sub toward the wellbore casing and the receiving of the acoustic waves is performed with the plurality of ultrasonic transducers.

15. The method of claim 14, wherein the plurality of ultrasonic transmitters and the plurality of ultrasonic receivers are separated forming a pitch-catch configuration and the acoustic waves are transmitted from one of the plurality of ultrasonic transmitters at a first location and are received by one of the plurality of ultrasonic receivers at a second location spaced from the first location.

16. The method of claim 15, wherein the ultrasonic transducers are at a non-perpendicular angle with respect to the inner surface of the catcher sub and the acoustic waves are transmitted by one of the plurality of ultrasonic transmitters from a first location at a non-perpendicular angle with respect to a longitudinal axis of the casing and are received at a second location spaced from the first location at a non-perpendicular angle with respect to the longitudinal axis of the casing by one of the plurality of ultrasonic receivers.

17. The method of claim 15, further comprising maximizing a magnitude of an echo of acoustic waves including compressional acoustic waves and shear acoustic waves off the outer surface of the casing by at least one of (1) transmitting the compressional acoustic waves from one of the plurality of ultrasonic transmitters into the catcher sub at an angle of less than 40 degrees with respect to a longitudinal axis of the casing and (2) transmitting shear acoustic waves into the catcher sub at an angle of 33 to 87 degrees with respect to the longitudinal axis of the casing.

18. The method of claim 15, wherein the plurality of ultrasonic transducers are positioned at an angle with respect to the longitudinal axis of the casing and the acoustic waves are transmitted by one of the plurality of ultrasonic transmitters from a first location at a non-perpendicular angle with respect to the longitudinal axis of the casing and are received at a second location spaced from the first location at a non-perpendicular angle with respect to the longitudinal axis of the casing by the ultrasonic receiver.

19. The method of claim 14, further comprising using recorded data from each of the plurality of ultrasonic receivers to calculate the distance from each of the plurality of ultrasonic receivers to the inner surface of the casing.

20. The method of claim 15, further comprising positioning the plurality of ultrasonic transmitters and the plurality of ultrasonic receivers forming the pitch-catch configuration within the wellbore casing, such that reverberations in the catcher sub reaching the ultrasonic receiver at the same time as echoes from the casing are reflected at least 3 times between an inner and outer diameter of the catcher sub.

21. The method of claim 14, further comprising measuring accelerations and angular positions of the logging tool during pull out of the drill string.

22. The method of claim 21, further comprising using detection of standstill positions during pull out of the drill string.

23. A method for measuring a thickness of casing in a wellbore and/or analyzing an inner surface of a cased or non-cased wellbore, comprising:

positioning a drill string in a wellbore;

positioning an untethered logging tool in the drill string;

pumping fluid into the drill string so that the fluid pushes the logging tool toward a remote end of the drill string so that the logging tool moves in an untethered manner;

receiving the logging tool in a catcher sub positioned within the drill string;

positioning a plurality of ultrasonic transducers with the average distance between an outer surface of the plurality of ultrasonic transducers and an interior surface of the catcher sub being less than 0.8 mm;

moving the drill string and the logging tool toward a mouth of the wellbore;

while moving the drill string and the logging tool toward a mouth of the wellbore, transmitting acoustic waves through the catcher sub toward the wellbore casing with the logging tool and receiving acoustic waves after the acoustic waves interact with the wellbore casing and reflect back to the logging tool through the catcher;

while moving the drill string and the logging tool toward the mouth of the wellbore, processing and storing data; and filtering peaks by subtracting reflected acoustic echoes from different interfaces using an expected replica of acoustic echo and time data.

24. The method of claim 23, wherein the filtering of peaks in a filter output is determined by frequency sweeps.

25. A method for measuring a thickness of casing in a wellbore and/or analyzing an inner surface of a cased or non-cased wellbore, comprising:

positioning a drill string in a wellbore;

positioning an untethered logging tool in the drill string;

pumping fluid into the drill string so that the fluid pushes the logging tool toward a remote end of the drill string so that the logging tool moves in an untethered manner;

receiving the logging tool in a catcher sub positioned within the drill string;

positioning a plurality of ultrasonic transducers with the average distance between an outer surface of the plurality of ultrasonic transducers and an interior surface of the catcher sub being less than 0.8 mm;

moving the drill string and the logging tool toward a mouth of the wellbore;

while moving the drill string and the logging tool toward a mouth of the wellbore, transmitting acoustic waves through the catcher sub toward the wellbore casing with the logging tool and receiving acoustic waves after the acoustic waves interact with the wellbore casing and reflect back to the logging tool through the catcher;

while moving the drill string and the logging tool toward the mouth of the wellbore, processing and storing data; and pressing a plurality of ultrasonic transducers against the inner surface of the catcher sub, wherein the transmitting acoustic waves through the catcher sub toward the wellbore casing and the receiving of the acoustic waves is performed with the plurality of ultrasonic transducers;

wherein the plurality of ultrasonic transducers further comprise a layer of coupling material over at least a portion of a surface of each of the plurality of ultrasonic transducers which has a yield strength lower than a yield strength of the catcher sub, wherein the pressing step further comprises pressing the layer of coupling material against the catcher sub.

26. A method for measuring a thickness of casing in a wellbore and/or analyzing an inner surface of a cased or non-cased wellbore, comprising:

positioning a drill string in a wellbore;

positioning an untethered logging tool in the drill string;

pumping fluid into the drill string so that the fluid pushes the logging tool toward a remote end of the drill string so that the logging tool moves in an untethered manner;

receiving the logging tool in a catcher sub positioned within the drill string;

positioning a plurality of ultrasonic transducers with the average distance between an outer surface of the plurality of ultrasonic transducers and an interior surface of the catcher sub being less than 0.8 mm;

moving the drill string and the logging tool toward a mouth of the wellbore;

while moving the drill string and the logging tool toward a mouth of the wellbore, transmitting acoustic waves through the catcher sub toward the wellbore casing with the logging tool and receiving acoustic waves after the acoustic waves interact with the wellbore casing and reflect back to the logging tool through the catcher; and while moving the drill string and the logging tool toward the mouth of the wellbore, processing and storing data;

wherein the plurality of ultrasonic transducers further comprise a layer of coupling material over at least a portion of a surface of each of the plurality of ultrasonic transducers wherein the layer of covering material has at least compressional or a shear acoustic impedance greater than at least 4% of the respective impedances of catcher sub and has a yield strength lower than the yield strength of the catcher sub, wherein the pressing step further comprises pressing the layer of coupling material against the catcher sub.

27. A method for measuring a thickness of casing in a wellbore and/or analyzing an inner surface of a cased or non-cased wellbore, comprising:

positioning a drill string in a wellbore;

positioning an untethered logging tool in the drill string;

pumping fluid into the drill string so that the fluid pushes the logging tool toward a remote end of the drill string so that the logging tool moves in an untethered manner;

receiving the logging tool in a catcher sub positioned within the drill string;

positioning a plurality of ultrasonic transducers with the average distance between an outer surface of the plurality of ultrasonic transducers and an interior surface of the catcher sub being less than 0.8 mm;

moving the drill string and the logging tool toward a mouth of the wellbore;

while moving the drill string and the logging tool toward a mouth of the wellbore, transmitting acoustic waves through the catcher sub toward the wellbore casing with the logging tool and receiving acoustic waves after the acoustic waves interact with the wellbore casing and reflect back to the logging tool through the catcher;

while moving the drill string and the logging tool toward the mouth of the wellbore, processing and storing data; and assigning an azimuthal angle span on the surface of the casing based on matching measured values to one or more of (1) look up tables or (2) simulator data.

28. A method for measuring a thickness of casing in a wellbore and/or analyzing an inner surface of a cased or non-cased wellbore, comprising:

positioning a drill string in a wellbore;

positioning an untethered logging tool in the drill string;

pumping fluid into the drill string so that the fluid pushes the logging tool toward a remote end of the drill string so that the logging tool moves in an untethered manner;

receiving the logging tool in a catcher sub positioned within the drill string;

positioning a plurality of ultrasonic transducers with the average distance between an outer surface of the plurality of ultrasonic transducers and an interior surface of the catcher sub being less than 0.8 mm;

moving the drill string and the logging tool toward a mouth of the wellbore;

while moving the drill string and the logging tool toward a mouth of the wellbore, transmitting acoustic waves through the catcher sub toward the wellbore casing with the logging tool and receiving acoustic waves after the acoustic waves interact with the wellbore casing and reflect back to the logging tool through the catcher;

while moving the drill string and the logging tool toward the mouth of the wellbore, processing and storing data; and calculating a distance to an outer casing wall based on at least two of the following: (1) data stored on a look up table, (2) an eccentricity of the catcher sub within the casing, (3) an azimuthal angle span, (4) a difference between an arrival time of at least one echo from the inner casing surface and the outer casing surface.

29. A method for measuring a thickness of casing in a wellbore and/or analyzing an inner surface of a cased or non-cased wellbore, comprising:

positioning a drill string in a wellbore;

positioning an untethered logging tool in the drill string;

pumping fluid into the drill string so that the fluid pushes the logging tool toward a remote end of the drill string so that the logging tool moves in an untethered manner;

receiving the logging tool in a catcher sub positioned within the drill string;

positioning a plurality of ultrasonic transducers with the average distance between an outer surface of the plurality of ultrasonic transducers and an interior surface of the catcher sub being less than 0.8 mm;

moving the drill string and the logging tool toward a mouth of the wellbore;

while moving the drill string and the logging tool toward a mouth of the wellbore, transmitting acoustic waves through the catcher sub toward the wellbore casing with the logging tool and receiving acoustic waves after the acoustic waves interact with the wellbore casing and reflect back to the logging tool through the catcher; and while moving the drill string and the logging tool toward the mouth of the wellbore, processing and storing data;

wherein after a pre-selected number of transmissions, the ultrasonic transducers do not generate ultrasonic waves until the tool senses that the logging tool has moved along the wellbore.

30. A method for measuring a thickness of casing in a wellbore and/or analyzing an inner surface of a cased or non-cased wellbore, comprising:

positioning a drill string in a wellbore;

positioning an untethered logging tool in the drill string;

pumping fluid into the drill string so that the fluid pushes the logging tool toward a remote end of the drill string so that the logging tool moves in an untethered manner;

receiving the logging tool in a catcher sub positioned within the drill string;

positioning a plurality of ultrasonic transducers with the average distance between an outer surface of the plurality of ultrasonic transducers and an interior surface of the catcher sub being less than 0.8 mm;

moving the drill string and the logging tool toward a mouth of the wellbore;

while moving the drill string and the logging tool toward a mouth of the wellbore, transmitting acoustic waves through the catcher sub toward the wellbore casing with the logging tool and receiving acoustic waves after the acoustic waves interact with the wellbore casing and reflect back to the logging tool through the catcher;

while moving the drill string and the logging tool toward the mouth of the wellbore, processing and storing data; and wherein the plurality of ultrasonic transducers include a plurality of ultrasonic transmitters and a plurality of ultrasonic receivers; further comprising (1) positioning the plurality of ultrasonic transducers sufficiently close to the inner surface of the catcher sub to achieve acoustic transmission between the surface of the catcher sub and (2) wherein the transmitting acoustic waves through the catcher sub toward the wellbore casing and the receiving of the acoustic waves is performed with the plurality of ultrasonic transducers;

measuring accelerations and angular positions of the logging tool during pull out of the drill string;

using detection of standstill positions during pull out of the drill string;

using the detected standstill positions to correct IMU bias shift.

31. A method for measuring a thickness of casing in a wellbore and/or analyzing an inner surface of a cased or non-cased wellbore, comprising:

positioning a drill string in a wellbore;

positioning an untethered logging tool in the drill string;

pumping fluid into the drill string so that the fluid pushes the logging tool toward a remote end of the drill string so that the logging tool moves in an untethered manner;

receiving the logging tool in a catcher sub positioned within the drill string;

positioning a plurality of ultrasonic transducers with the average distance between an outer surface of the plurality of ultrasonic transducers and an interior surface of the catcher sub being less than 0.8 mm;

moving the drill string and the logging tool toward a mouth of the wellbore;

while moving the drill string and the logging tool toward a mouth of the wellbore, transmitting acoustic waves through the catcher sub toward the wellbore casing with the logging tool and receiving acoustic waves after the acoustic waves interact with the wellbore casing and reflect back to the logging tool through the catcher; and while moving the drill string and the logging tool toward the mouth of the wellbore, processing and storing data;

wherein the plurality of ultrasonic transducers include a plurality of ultrasonic transmitters and a plurality of ultrasonic receivers; further comprising:

(1) positioning the plurality of ultrasonic transducers sufficiently close to the inner surface of the catcher sub to achieve acoustic transmission between the surface of the catcher sub and (2) wherein the transmitting acoustic waves through the catcher sub toward the wellbore casing and the receiving of the acoustic waves is performed with the plurality of ultrasonic transducers;

wherein the plurality of ultrasonic transmitters and the plurality of ultrasonic receivers are separated forming a pitch-catch configuration and the acoustic waves are transmitted from one of the plurality of ultrasonic transmitters at a first location and are received by one of the plurality of ultrasonic receivers at a second location spaced from the first location;

deflecting and/or absorbing the acoustic waves from the catcher sub by deflecting/absorbing material being a part of the logging tool or being a part of the catcher sub;

wherein the deflecting/absorbing material is positioned between one of the plurality of ultrasonic transmitters and one of the plurality of the ultrasonic receivers in the pitch-catch configuration.

32. An apparatus for measuring a thickness of casing in a wellbore and/or analyzing an inner surface of a cased or non-cased wellbore, comprising:

an untethered logging tool;

a catcher sub configured to be positioned within a drill string;

wherein when the logging tool is positioned within the catcher sub a plurality ultrasonic transducers are positioned with respect to an interior surface of the catcher such that the average distance between an outer surface of transducers and an inner surface of the catcher sub less than 0.8 mm;

the logging tool including a transmitter configured to transmit acoustic waves through the catcher sub and a receiver configured to detect acoustic waves after the acoustic waves interact with the wellbore casing and reflect back to the logging tool through the catcher sub;

a data processor for storing data regarding the acoustic waves; and deflecting/absorbing material comprising at least one of a part of the logging tool and a part of the catcher sub, wherein the deflecting/absorbing material is positioned between an ultrasonic transmitter and an ultrasonic receiver in a pitch-catch configuration.

33. An apparatus for measuring a thickness of casing in a wellbore and/or analyzing an inner surface of a cased or non-cased wellbore, comprising:

an untethered logging tool;

a catcher sub configured to be positioned within a drill string;

wherein when the logging tool is positioned within the catcher sub a plurality ultrasonic transducers are positioned with respect to an interior surface of the catcher such that the average distance between an outer surface of transducers and an inner surface of the catcher sub less than 0.8 mm;

the logging tool including a transmitter configured to transmit acoustic waves through the catcher sub and a receiver configured to detect acoustic waves after the acoustic waves interact with the wellbore casing and reflect back to the logging tool through the catcher sub;

a data processor for storing data regarding the acoustic waves;

a layer of coupling material coating at least a portion of one of the plurality of ultrasonic transducers which has a yield strength lower than a yield strength of the catcher sub.

34. The apparatus of claim 33, further comprising a drill string providing fluid communication with the interior of the catcher sub.

35. The apparatus of claim 33, wherein the plurality of ultrasonic transducers are sufficiently close to the inner surface of the catcher sub when the logging tool is positioned in the catcher to achieve acoustic transmission between the surface of the catcher sub and the inner surface of the catcher sub.

36. The apparatus of claim 33, wherein the plurality of ultrasonic transducers are positioned against the inner surface of the catcher sub when the logging tool is positioned in the catcher.

37. The apparatus of claim 33, wherein the plurality of ultrasonic transducers are positioned against the inner surface of the catcher sub in each quadrant of the catcher sub in a cross-section perpendicular to a longitudinal axis of the catcher sub when the logging tool is positioned in the catcher.

38. The apparatus of claim 33, further comprising a sensor to determine when drill string is stopped and an accelerometer for determining a length of time the drill string is stopped.

39. The apparatus of claim 33, wherein the layer of coupling material has one of at least compressional or shear acoustic impedance greater than at least 4% of the respective impedance of catcher sub and the yield strength of the catcher sub.

40. The apparatus of claim 33, wherein the plurality of ultrasonic transducers comprises an ultrasonic transmitter and an ultrasonic receiver separated in a pitch-catch configuration such that the acoustic waves are transmitted from the ultrasonic transmitter at a first location and are received by the ultrasonic receiver at a second location spaced from the first location.

41. The apparatus of claim 40, wherein the plurality of ultrasonic transducers are at a non-perpendicular angle with respect to the inner surface of the catcher sub.

42. The apparatus of claim 40, wherein at least the ultrasonic transmitter is positioned to transmit compressional acoustic waves from the ultrasonic transmitter into the catcher sub at an angle of less than 40 degrees with respect to a longitudinal axis of the casing and the ultrasonic transmitter is positioned to transmit shear acoustic waves into the catcher sub at an angle of 33 to 87 degrees with respect to the longitudinal axis of the casing.

43. The apparatus of claim 33, wherein the plurality ultrasonic transducers comprise a plurality of ultrasonic receivers positioned to receive waves at a plurality of locations azimuthally spaced apart and longitudinally spaced apart from a plurality of ultrasonic transmitters.

44. The apparatus of claim 33, further comprising a display configured to illustrate a visual representation of casing wear based on the stored data from the acoustic waves.

45. The apparatus of claim 33, wherein said plurality of transducers are configured to send a wide band frequency signal which comprises at least one of frequency sweep and short pulse.

46. The apparatus of claim 33, wherein the plurality of transducers are configured to transmit with a bandwidth greater than 0.1 megahertz.

47. The apparatus of claim 33, wherein the plurality of transducers are configured to transmit with a frequency greater than 0.05 megahertz and less than 1.5 megahertz.

48. The apparatus of claim 33, further comprising at least one accelerometer and at least one gyroscope.

49. The apparatus of claim 33, further comprising a memory within the logging tool.

50. The apparatus of claim 49, wherein at least one of the logging tool and a processor external to the wellbore has a memory which stores at least one or more of (1) look up tables or (2) simulator data.

51. The method of claim 33, wherein the the ultrasonic transmitter and the ultrasonic receiver in the pitch-catch configuration are positioned such that in operation reverberations in the catcher sub reaching the ultrasonic receiver at the same time as echoes from the casing are reflected at least 3 times between an inner and an outer diameter of the catcher sub.

* * * * *